US011523212B2

(12) United States Patent
Ansai et al.

(10) Patent No.: US 11,523,212 B2
(45) Date of Patent: Dec. 6, 2022

(54) PATTERN-FORMING MICROPHONE ARRAY

(71) Applicant: Shure Acquisition Holdings, Inc., Niles, IL (US)

(72) Inventors: Michelle Michiko Ansai, Chicago, IL (US); John Casey Gibbs, Chicago, IL (US); Mathew T. Abraham, Colorado Springs, CO (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/409,239

(22) Filed: May 10, 2019

(65) Prior Publication Data

US 2019/0373362 A1 Dec. 5, 2019

Related U.S. Application Data

(60) Provisional application No. 62/679,452, filed on Jun. 1, 2018.

(51) Int. Cl.
*H04R 3/00* (2006.01)
*H04R 1/40* (2006.01)
(Continued)

(52) U.S. Cl.
CPC ..... *H04R 1/406* (2013.01); *H04R 3/005* (2013.01); *H04R 3/04* (2013.01); *H04R 19/04* (2013.01); *H04R 2201/003* (2013.01)

(58) Field of Classification Search
CPC .. H04R 3/005; H04R 5/027; H04R 2201/401; H04R 2201/003; H04R 1/20; H04R 3/14
(Continued)

(56) References Cited

U.S. PATENT DOCUMENTS 1,535,408 A 4/1925 Fricke
1,540,788 A 6/1925 Mcclure
(Continued)

FOREIGN PATENT DOCUMENTS

CA 2359771 4/2003
CA 2475283 1/2005
(Continued)

OTHER PUBLICATIONS

International Search Report and Written Opinion for PCT/US2019/031833 dated Jul. 24, 2019, 16 pp.
(Continued)

*Primary Examiner* — George C Monikang
(74) *Attorney, Agent, or Firm* — Neal, Gerber & Eisenberg LLP

(57) ABSTRACT

Embodiments include a microphone array with a plurality of microphone elements comprising a first set of elements arranged along a first axis, comprising at least two microphone elements spaced apart by a first distance; a second set of elements arranged along the first axis, comprising at least two microphone elements spaced apart by a second, greater distance, such that the first set is nested within the second set; a third set of elements arranged along a second axis orthogonal to the first axis, comprising at least two microphone elements spaced apart by the second distance; and a fourth set of elements nested within the third set along the second axis, comprising at least two microphone elements spaced apart by the first distance, wherein each set includes a first cluster of microphone elements and a second cluster of microphone elements spaced apart by the specified distance.

23 Claims, 7 Drawing Sheets

(51) Int. Cl.
*H04R 3/04* (2006.01)
*H04R 19/04* (2006.01)

(58) Field of Classification Search
USPC ..... 381/92, 122
See application file for complete search history.

(56) References Cited

U.S. PATENT DOCUMENTS

| | | | |
|---|---|---|---|
| 2,075,588 | A | 3/1937 | Meyers |
| 2,113,219 | A | 4/1938 | Olson |
| 2,164,655 | A | 7/1939 | Kleerup |
| D122,771 | S | 10/1940 | Doner |
| 2,233,412 | A | 3/1941 | Hill |
| 2,268,529 | A | 12/1941 | Stiles |
| 2,343,037 | A | 2/1944 | William, I |
| 2,377,449 | A | 6/1945 | Prevette |
| 2,481,250 | A | 9/1949 | Schneider |
| 2,539,671 | A | 1/1951 | Olson |
| 2,777,232 | A | 1/1957 | Kulicke |
| 2,828,508 | A | 4/1958 | Labarre |
| 2,882,633 | A | 4/1959 | Howell |
| 2,950,556 | A | 8/1960 | Larios |
| 3,132,713 | A | 5/1964 | Seeler |
| 3,160,225 | A | 12/1964 | Sechrist |
| 3,239,973 | A | 3/1966 | Hannes |
| 3,240,883 | A | 3/1966 | Seeler |
| 3,310,901 | A | 3/1967 | Sarkisian |
| 3,321,170 | A | 5/1967 | Vye |
| 3,573,399 | A | 4/1971 | Schroeder |
| 3,657,490 | A | 4/1972 | Scheiber |
| 3,696,885 | A | 10/1972 | Grieg |
| 3,755,625 | A | 8/1973 | Maston |
| 3,828,508 | A | 8/1974 | Moeller |
| 3,861,713 | A | 1/1975 | McKee |
| 3,895,194 | A | 7/1975 | Fraim |
| 3,906,431 | A | 9/1975 | Clearwaters |
| D237,103 | S | 10/1975 | Fisher |
| 3,936,606 | A | 2/1976 | Wanke |
| 3,992,584 | A | 11/1976 | Dugan |
| 4,007,461 | A | 2/1977 | Luedtke |
| 4,070,547 | A | 1/1978 | Dellar |
| 4,072,821 | A | 2/1978 | Bauer |
| 4,096,353 | A | 6/1978 | Bauer |
| 4,127,156 | A | 11/1978 | Brandt |
| 4,131,760 | A | 12/1978 | Christensen |
| 4,169,219 | A | 9/1979 | Beard |
| 4,184,048 | A | 1/1980 | Alcaide |
| 4,198,705 | A | 4/1980 | Massa |
| 4,237,339 | A | 12/1980 | Bunting |
| 4,244,906 | A | 1/1981 | Heinemann |
| 4,254,417 | A | 3/1981 | Speiser |
| 4,275,694 | A | 6/1981 | Nagaishi |
| 4,296,280 | A | 10/1981 | Richie |
| 4,305,141 | A | 12/1981 | Massa |
| 4,308,425 | A | 12/1981 | Momose |
| 4,311,874 | A | 1/1982 | Wallace, Jr. |
| 4,330,691 | A | 5/1982 | Gordon |
| 4,334,740 | A | 6/1982 | Wray |
| 4,365,449 | A | 12/1982 | Liautaud |
| 4,373,191 | A | 2/1983 | Fette |
| 4,393,631 | A | 7/1983 | Krent |
| 4,414,433 | A | 11/1983 | Horie |
| 4,429,850 | A | 2/1984 | Weber |
| 4,436,966 | A | 3/1984 | Botros |
| 4,449,238 | A | 5/1984 | Lee |
| 4,466,117 | A | 8/1984 | Rudolf |
| 4,485,484 | A | 11/1984 | Flanagan |
| 4,489,442 | A | 12/1984 | Anderson |
| 4,521,908 | A | 6/1985 | Miyaji |
| 4,593,404 | A | 6/1986 | Bolin |
| 4,594,478 | A | 6/1986 | Gumb |
| D285,067 | S | 8/1986 | Delbuck |
| 4,625,827 | A | 12/1986 | Bartle, I |
| 4,653,102 | A | 3/1987 | Hansen |
| 4,658,425 | A | 4/1987 | Julstrom |
| 4,669,108 | A | 5/1987 | Deinzer |
| 4,675,906 | A | 6/1987 | Sessler |
| 4,693,174 | A | 9/1987 | Anderson |
| 4,696,043 | A | 9/1987 | Iwahara |
| 4,712,231 | A | 12/1987 | Julstrom |
| 4,741,038 | A | 4/1988 | Elko |
| 4,752,961 | A | 6/1988 | Kahn |
| 4,805,730 | A | 2/1989 | O'Neill |
| 4,815,132 | A | 3/1989 | Minami |
| 4,860,366 | A | 8/1989 | Fukushi |
| 4,862,507 | A | 8/1989 | Woodard |
| 4,866,868 | A | 9/1989 | Kass |
| 4,881,135 | A | 11/1989 | Heilweil |
| 4,888,807 | A | 12/1989 | Reichel |
| 4,903,247 | A | 2/1990 | Van Gerwen |
| 4,923,032 | A | 5/1990 | Nuernberger |
| 4,928,312 | A | 5/1990 | Hill |
| 5,000,286 | A | 3/1991 | Crawford |
| 5,058,170 | A | 10/1991 | Kanamori |
| 5,088,574 | A | 2/1992 | Kertesz, III |
| 5,121,426 | A | 6/1992 | Baumhauer |
| 5,189,701 | A | 2/1993 | Jain |
| 5,204,907 | A | 4/1993 | Staple |
| 5,214,709 | A | 5/1993 | Ribic |
| 5,289,544 | A | 2/1994 | Franklin |
| 5,297,210 | A | 3/1994 | Julstrom |
| 5,323,459 | A | 6/1994 | Hirano |
| 5,329,593 | A | 7/1994 | Lazzeroni |
| 5,335,011 | A | 8/1994 | Addeo |
| 5,353,279 | A | 10/1994 | Koyama |
| 5,371,789 | A | 12/1994 | Hirano |
| 5,384,843 | A | 1/1995 | Masuda |
| 5,396,554 | A | 3/1995 | Hirano |
| 5,473,701 | A | 12/1995 | Cezanne |
| 5,509,634 | A | 4/1996 | Gebka |
| 5,513,265 | A | 4/1996 | Hirano |
| 5,525,765 | A | 6/1996 | Freiheit |
| 5,550,924 | A | 8/1996 | Helf |
| 5,550,925 | A | 8/1996 | Hori |
| 5,555,447 | A | 9/1996 | Kotzin |
| 5,574,793 | A | 11/1996 | Hirschhorn |
| 5,602,962 | A | 2/1997 | Kellermann |
| 5,633,936 | A | 5/1997 | Oh |
| 5,645,257 | A | 7/1997 | Ward |
| D382,118 | S | 8/1997 | Ferrero |
| 5,657,393 | A | 8/1997 | Crow |
| 5,661,813 | A | 8/1997 | Shimauchi |
| 5,673,327 | A | 9/1997 | Julstrom |
| 5,687,229 | A | 11/1997 | Sih |
| 5,706,344 | A | 1/1998 | Finn |
| 5,715,319 | A | 2/1998 | Chu |
| 5,717,171 | A | 2/1998 | Miller |
| 5,761,318 | A | 6/1998 | Shimauchi |
| 5,766,702 | A | 6/1998 | Lin |
| 5,787,183 | A | 7/1998 | Chu |
| 5,796,819 | A | 8/1998 | Romesburg |
| 5,848,146 | A | 12/1998 | Slattery |
| 5,870,482 | A | 2/1999 | Loeppert |
| 5,878,147 | A | 3/1999 | Killion |
| 5,888,412 | A | 3/1999 | Sooriakumar |
| 5,888,439 | A | 3/1999 | Miller |
| D416,315 | S | 11/1999 | Nanjo |
| 5,978,211 | A | 11/1999 | Hong |
| 5,991,277 | A | 11/1999 | Maeng |
| 6,039,457 | A | 3/2000 | O'Neal |
| 6,041,127 | A | 3/2000 | Elko |
| 6,049,607 | A | 4/2000 | Marash |
| 6,069,961 | A | 5/2000 | Nakazawa |
| 6,125,179 | A | 9/2000 | Wu |
| 6,128,395 | A | 10/2000 | De Vries |
| 6,137,887 | A | 10/2000 | Anderson |
| 6,151,399 | A | 11/2000 | Killion |
| 6,173,059 | B1 | 1/2001 | Huang |
| 6,194,863 | B1 | 2/2001 | Mainberger |
| 6,205,224 | B1 | 3/2001 | Underbrink |
| 6,215,881 | B1 | 4/2001 | Azima |
| 6,301,357 | B1 | 10/2001 | Romesburg |
| 6,329,908 | B1 | 12/2001 | Frecska |
| 6,332,029 | B1 | 12/2001 | Azima |

(56) References Cited

U.S. PATENT DOCUMENTS

| | | | |
|---|---|---|---|
| 6,386,315 | B1 | 5/2002 | Roy |
| 6,424,635 | B1 | 7/2002 | Song |
| 6,442,272 | B1 | 8/2002 | Osovets |
| 6,449,593 | B1 | 9/2002 | Valve |
| 6,481,173 | B1 | 11/2002 | Roy |
| 6,488,367 | B1 | 12/2002 | Debesis |
| D469,090 | S | 1/2003 | Tsuji |
| 6,505,057 | B1 | 1/2003 | Finn |
| 6,507,659 | B1 | 1/2003 | Iredale |
| 6,510,919 | B1 | 1/2003 | Roy |
| 6,526,147 | B1 | 2/2003 | Rung |
| 6,556,682 | B1 | 4/2003 | Gilloire |
| 6,592,237 | B1 | 7/2003 | Pledger |
| 6,622,030 | B1 | 9/2003 | Romesburg |
| D480,923 | S | 10/2003 | Neubourg |
| 6,633,647 | B1 | 10/2003 | Markow |
| 6,665,971 | B2 | 12/2003 | Lowry |
| 6,694,028 | B1 | 2/2004 | Matsuo |
| 6,704,422 | B1 | 3/2004 | Jensen |
| 6,724,829 | B1 | 4/2004 | Tzukerman |
| 6,731,334 | B1 | 5/2004 | Maeng |
| 6,741,720 | B1 | 5/2004 | Myatt |
| 6,757,393 | B1 | 6/2004 | Spitzer |
| 6,768,795 | B2 | 7/2004 | Men |
| 6,868,377 | B1 | 3/2005 | Laroche |
| 6,885,750 | B2 | 4/2005 | Egelmeers |
| 6,885,986 | B1 | 4/2005 | Gigi |
| 6,889,183 | B1 | 5/2005 | Gunduzhan |
| 6,895,093 | B1 | 5/2005 | Ml |
| 6,931,123 | B1 | 8/2005 | Hughes |
| 6,944,312 | B2 | 9/2005 | Mason |
| D510,729 | S | 10/2005 | Chen |
| 6,968,064 | B1 | 11/2005 | Ning |
| 6,990,193 | B2 | 1/2006 | Beaucoup |
| 6,993,126 | B1 | 1/2006 | Kyrylenko |
| 7,003,099 | B1 | 2/2006 | Zhang |
| 7,013,267 | B1 | 3/2006 | Huart |
| 7,031,269 | B2 | 4/2006 | Lee |
| 7,035,398 | B2 | 4/2006 | Matsuo |
| 7,035,415 | B2 | 4/2006 | Belt |
| 7,050,576 | B2 | 5/2006 | Zhang |
| 7,054,451 | B2 | 5/2006 | Janse |
| 7,092,516 | B2 | 8/2006 | Furuta |
| 7,092,882 | B2 | 8/2006 | Arrowood |
| 7,098,865 | B2 | 8/2006 | Christensen |
| 7,106,876 | B2 | 9/2006 | Santiago |
| 7,120,269 | B2 | 10/2006 | Lowell |
| 7,130,309 | B2 | 10/2006 | Boaz |
| D533,177 | S | 12/2006 | Andre |
| 7,149,320 | B2 | 12/2006 | Haykin |
| 7,161,534 | B2 | 1/2007 | Tsai |
| 7,187,765 | B2 | 3/2007 | Popovic |
| 7,203,308 | B2 | 4/2007 | Kubota |
| 7,212,628 | B2 | 5/2007 | Mirjana |
| D546,814 | S | 7/2007 | Takita |
| 7,239,714 | B2 | 7/2007 | de Blok |
| 7,269,263 | B2 | 9/2007 | Dedieu |
| 7,333,476 | B2 | 2/2008 | LeBlanc |
| 7,359,504 | B1 | 4/2008 | Reuss |
| 7,366,310 | B2 | 4/2008 | Stinson |
| 7,412,376 | B2 | 8/2008 | Florencio |
| 7,415,117 | B2 | 8/2008 | Tashev |
| D581,510 | S | 11/2008 | Albano |
| D582,391 | S | 12/2008 | Morimoto |
| 7,503,616 | B2 | 3/2009 | Linhard |
| 7,515,719 | B2 | 4/2009 | Hooley |
| 7,536,769 | B2 | 5/2009 | Pedersen |
| D595,402 | S | 6/2009 | Miyake |
| 7,558,381 | B1 | 7/2009 | Ali |
| D601,585 | S | 10/2009 | Andre |
| 7,651,390 | B1 | 1/2010 | Profeta |
| 7,660,428 | B2 | 2/2010 | Rodman |
| 7,667,728 | B2 | 2/2010 | Kenoyer |
| 7,672,445 | B1 | 3/2010 | Zhang |
| 7,701,110 | B2 | 4/2010 | Fukuda |
| 7,702,116 | B2 | 4/2010 | Stone |
| 7,724,891 | B2 | 5/2010 | Beaucoup |
| D617,441 | S | 6/2010 | Koury |
| 7,747,001 | B2 | 6/2010 | Kellermann |
| 7,756,278 | B2 | 7/2010 | Moorer |
| 7,783,063 | B2 | 8/2010 | Pocino |
| 7,787,328 | B2 | 8/2010 | Chu |
| 7,830,862 | B2 | 11/2010 | James |
| 7,831,035 | B2 | 11/2010 | Stokes |
| 7,831,036 | B2 | 11/2010 | Beaucoup |
| 7,856,097 | B2 | 12/2010 | Tokuda |
| 7,881,486 | B1 | 2/2011 | Killion |
| 7,894,421 | B2 | 2/2011 | Kwan |
| 7,925,006 | B2 | 4/2011 | Hirai |
| 7,925,007 | B2 | 4/2011 | Stokes |
| 7,936,886 | B2 | 5/2011 | Kim |
| 7,970,123 | B2 | 6/2011 | Beaucoup |
| 7,970,151 | B2 | 6/2011 | Oxford |
| 3,000,481 | A1 | 8/2011 | Kiyoshi |
| 3,005,238 | A1 | 8/2011 | Ivan |
| 7,991,167 | B2 | 8/2011 | Oxford |
| 7,995,768 | B2 | 8/2011 | Miki |
| 8,019,091 | B2 | 9/2011 | Burnett |
| 8,041,054 | B2 | 10/2011 | Yeldener |
| 8,059,843 | B2 | 11/2011 | Hung |
| 8,085,947 | B2 | 12/2011 | Haulick |
| 8,085,949 | B2 | 12/2011 | Kim |
| 3,095,120 | A1 | 1/2012 | Colin |
| 8,098,842 | B2 | 1/2012 | Florencio |
| 8,098,844 | B2 | 1/2012 | Elko |
| 8,103,030 | B2 | 1/2012 | Barthel |
| 8,112,272 | B2 | 2/2012 | Nagahama |
| 8,116,500 | B2 | 2/2012 | Oxford |
| 8,121,834 | B2 | 2/2012 | Rosec |
| D655,271 | S | 3/2012 | Park |
| D656,473 | S | 3/2012 | Laube |
| 3,135,143 | A1 | 3/2012 | Toshiaki |
| 8,130,969 | B2 | 3/2012 | Buck |
| 8,130,977 | B2 | 3/2012 | Chu |
| 8,144,886 | B2 | 3/2012 | Toshiaki |
| D658,153 | S | 4/2012 | Woo |
| 8,155,331 | B2 | 4/2012 | Nakadai |
| 3,170,882 | A1 | 5/2012 | Franklin |
| 3,175,291 | A1 | 5/2012 | Kwok-Leung |
| 3,175,871 | A1 | 5/2012 | Song |
| 3,184,801 | A1 | 5/2012 | Hamalainen |
| 8,189,765 | B2 | 5/2012 | Nishikawa |
| 8,189,810 | B2 | 5/2012 | Wolff |
| 8,199,927 | B1 | 6/2012 | Raftery |
| 8,204,198 | B2 | 6/2012 | Adeney |
| 8,204,248 | B2 | 6/2012 | Haulick |
| 8,208,664 | B2 | 6/2012 | Iwasaki |
| 8,213,596 | B2 | 7/2012 | Beaucoup |
| 8,213,634 | B1 | 7/2012 | Daniel |
| 8,219,387 | B2 | 7/2012 | Cutler |
| 8,229,134 | B2 | 7/2012 | Duraiswami |
| 8,233,352 | B2 | 7/2012 | Beaucoup |
| 8,243,951 | B2 | 8/2012 | Ishibashi |
| 8,244,536 | B2 | 8/2012 | Arun |
| 8,249,273 | B2 | 8/2012 | Inoda |
| 8,259,959 | B2 | 9/2012 | Marton |
| 8,275,120 | B2 | 9/2012 | Stokes, III |
| 8,280,728 | B2 | 10/2012 | Chen |
| 8,284,949 | B2 | 10/2012 | Farhang |
| 8,284,952 | B2 | 10/2012 | Reining |
| 8,286,749 | B2 | 10/2012 | Stewart |
| 8,290,142 | B1 | 10/2012 | Lambert |
| 8,291,670 | B2 | 10/2012 | Gard |
| 8,297,402 | B2 | 10/2012 | Stewart |
| 8,315,380 | B2 | 11/2012 | Liu |
| 8,331,582 | B2 | 12/2012 | Steele |
| 8,345,898 | B2 | 1/2013 | Reining |
| 8,355,521 | B2 | 1/2013 | Larson |
| 8,370,140 | B2 | 2/2013 | Guillaume |
| 8,379,823 | B2 | 2/2013 | Ratmanski |
| 8,385,557 | B2 | 2/2013 | Tashev |
| D678,329 | S | 3/2013 | Lee |
| 8,395,653 | B2 | 3/2013 | Feng |
| 8,403,107 | B2 | 3/2013 | Stewart |

(56) References Cited

U.S. PATENT DOCUMENTS

| | | | |
|---|---|---|---|
| 8,406,436 | B2 | 3/2013 | Craven |
| 8,428,661 | B2 | 4/2013 | Chen |
| 8,433,061 | B2 | 4/2013 | Cutler |
| D682,266 | S | 5/2013 | Wu |
| 8,437,490 | B2 | 5/2013 | Marton |
| 8,443,930 | B2 | 5/2013 | Stewart, Jr. |
| 8,447,590 | B2 | 5/2013 | Ishibashi |
| 8,472,639 | B2 | 6/2013 | Reining |
| 8,472,640 | B2 | 6/2013 | Marton |
| D686,182 | S | 7/2013 | Ashiwa |
| 8,479,871 | B2 | 7/2013 | Stewart |
| 8,483,398 | B2 | 7/2013 | Fozunbal |
| 8,498,423 | B2 | 7/2013 | Thaden |
| D687,432 | S | 8/2013 | Duan |
| 8,503,653 | B2 | 8/2013 | Ahuja |
| 8,515,089 | B2 | 8/2013 | Nicholson |
| 8,515,109 | B2 | 8/2013 | Dittberner |
| 8,526,633 | B2 | 9/2013 | Ukai |
| 8,553,904 | B2 | 10/2013 | Said |
| 8,559,611 | B2 | 10/2013 | Ratmanski |
| D693,328 | S | 11/2013 | Goetzen |
| 8,583,481 | B2 | 11/2013 | Walter |
| 3,605,890 | A1 | 12/2013 | Zhang |
| 8,599,194 | B2 | 12/2013 | Lewis |
| 8,600,443 | B2 | 12/2013 | Kawaguchi |
| 8,620,650 | B2 | 12/2013 | Walters |
| 8,631,897 | B2 | 1/2014 | Stewart |
| 8,634,569 | B2 | 1/2014 | Lu |
| 8,638,951 | B2 | 1/2014 | Zurek |
| D699,712 | S | 2/2014 | Bourne |
| 8,644,477 | B2 | 2/2014 | Gilbert |
| 8,654,955 | B1 | 2/2014 | Lambert |
| 8,654,990 | B2 | 2/2014 | Faller |
| 8,660,274 | B2 | 2/2014 | Wolff |
| 8,660,275 | B2 | 2/2014 | Buck |
| 8,672,087 | B2 | 3/2014 | Stewart |
| 8,675,890 | B2 | 3/2014 | Schmidt |
| 8,675,899 | B2 | 3/2014 | Jung |
| 8,676,728 | B1 | 3/2014 | Velusamy |
| 8,682,675 | B2 | 3/2014 | Togami |
| 8,730,156 | B2 | 5/2014 | Weising |
| 8,744,069 | B2 | 6/2014 | Cutler |
| 8,744,101 | B1 | 6/2014 | Burns |
| 8,755,536 | B2 | 6/2014 | Chen |
| 8,811,601 | B2 | 8/2014 | Mohammad |
| 8,818,002 | B2 | 8/2014 | Tashev |
| 8,824,693 | B2 | 9/2014 | Per |
| 8,842,851 | B2 | 9/2014 | Beaucoup |
| 8,855,326 | B2 | 10/2014 | Derkx |
| 8,855,327 | B2 | 10/2014 | Tanaka |
| 8,861,756 | B2 | 10/2014 | Zhu |
| 8,873,789 | B2 | 10/2014 | Bigeh |
| 8,886,343 | B2 | 11/2014 | Ishibashi |
| 8,893,849 | B2 | 11/2014 | Hudson |
| 8,898,633 | B2 | 11/2014 | Bryant |
| D718,731 | S | 12/2014 | Lee |
| 8,903,106 | B2 | 12/2014 | Meyer |
| 8,923,529 | B2 | 12/2014 | Mccowan |
| 8,929,564 | B2 | 1/2015 | Kikkeri |
| 8,942,382 | B2 | 1/2015 | Elko |
| 8,965,546 | B2 | 2/2015 | Erik |
| D725,059 | S | 3/2015 | Kim |
| 8,976,977 | B2 | 3/2015 | De |
| 8,983,089 | B1 | 3/2015 | Chu |
| 8,983,834 | B2 | 3/2015 | Davis |
| D727,968 | S | 4/2015 | Onoue |
| 9,002,028 | B2 | 4/2015 | Haulick |
| 9,038,301 | B2 | 5/2015 | Zelbacher |
| 9,088,336 | B2 | 7/2015 | Mani |
| 9,094,496 | B2 | 7/2015 | Teutsch |
| D735,717 | S | 8/2015 | Lam |
| 9,099,094 | B2 | 8/2015 | Burnei, I |
| 9,107,001 | B2 | 8/2015 | Diethorn |
| 9,111,543 | B2 | 8/2015 | Per |
| 9,113,242 | B2 | 8/2015 | Hyun |
| 9,113,247 | B2 | 8/2015 | Chatlani |
| 9,126,827 | B2 | 9/2015 | Hsieh |
| 9,129,223 | B1 | 9/2015 | Velusamy |
| 9,140,054 | B2 | 9/2015 | Oberbroeckling |
| D740,279 | S | 10/2015 | Wu |
| 9,172,345 | B2 | 10/2015 | Kok |
| 9,196,261 | B2 | 11/2015 | Burnei, I |
| 9,197,974 | B1 | 11/2015 | Clark |
| 9,203,494 | B2 | 12/2015 | Tarighat Mehrabani |
| 9,215,327 | B2 | 12/2015 | Bathurst |
| 9,215,543 | B2 | 12/2015 | Sun |
| 9,226,062 | B2 | 12/2015 | Sun |
| 9,226,070 | B2 | 12/2015 | Hyun |
| 9,226,088 | B2 | 12/2015 | Pandey |
| 9,232,185 | B2 | 1/2016 | Graham |
| 9,237,391 | B2 | 1/2016 | Benesty |
| 9,247,367 | B2 | 1/2016 | Nobile |
| 9,253,567 | B2 | 2/2016 | Morcelli |
| 9,257,132 | B2 | 2/2016 | Gowreesunker |
| 9,264,553 | B2 | 2/2016 | Pandey |
| 9,264,805 | B2 | 2/2016 | Buck |
| 9,280,985 | B2 | 3/2016 | Tawada |
| 9,286,908 | B2 | 3/2016 | Zhang |
| 9,294,839 | B2 | 3/2016 | Lambert |
| 9,301,049 | B2 | 3/2016 | Elko |
| 9,307,326 | B2 | 4/2016 | Elko |
| 9,319,532 | B2 | 4/2016 | Bao |
| 9,319,799 | B2 | 4/2016 | Salmon |
| 9,326,060 | B2 | 4/2016 | Nicholson |
| D756,502 | S | 5/2016 | Lee |
| 9,330,673 | B2 | 5/2016 | Cho |
| 9,338,301 | B2 | 5/2016 | Pocino |
| 9,338,549 | B2 | 5/2016 | Haulick |
| 9,354,310 | B2 | 5/2016 | Erik |
| 9,357,080 | B2 | 5/2016 | Beaucoup |
| 9,403,670 | B2 | 8/2016 | Schelling |
| 9,426,598 | B2 | 8/2016 | Walsh |
| D767,748 | S | 9/2016 | Nakai |
| 9,451,078 | B2 | 9/2016 | Yang |
| D769,239 | S | 10/2016 | Li |
| 9,462,378 | B2 | 10/2016 | Kuech |
| 9,473,868 | B2 | 10/2016 | Huang |
| 9,479,627 | B1 | 10/2016 | Rung |
| 9,479,885 | B1 | 10/2016 | Ivanov |
| 9,489,948 | B1 | 11/2016 | Chu |
| 9,510,090 | B2 | 11/2016 | Lissek |
| 9,514,723 | B2 | 12/2016 | Silfvast |
| 9,516,412 | B2 | 12/2016 | Shigenaga |
| 9,521,057 | B2 | 12/2016 | Klingbeil |
| 9,549,245 | B2 | 1/2017 | Frater |
| 9,560,451 | B2 | 1/2017 | Eichfeld |
| 9,565,493 | B2 | 2/2017 | Abraham |
| 9,578,413 | B2 | 2/2017 | Sawa |
| 9,578,440 | B2 | 2/2017 | Otto |
| 9,589,556 | B2 | 3/2017 | Gao |
| 9,591,123 | B2 | 3/2017 | Sorensen |
| 9,591,404 | B1 | 3/2017 | Chhetri |
| D784,299 | S | 4/2017 | Cho |
| 9,615,173 | B2 | 4/2017 | Sako |
| 9,628,596 | B1 | 4/2017 | Bullough |
| 9,635,186 | B2 | 4/2017 | Pandey |
| 9,635,474 | B2 | 4/2017 | Kuster |
| D787,481 | S | 5/2017 | Jorunn |
| D788,073 | S | 5/2017 | Silvera |
| 9,640,187 | B2 | 5/2017 | Niemisto |
| 9,641,688 | B2 | 5/2017 | Pandey |
| 9,641,929 | B2 | 5/2017 | Li |
| 9,641,935 | B1 | 5/2017 | Ivanov |
| 9,653,091 | B2 | 5/2017 | Matsuo |
| 9,653,092 | B2 | 5/2017 | Sun |
| 9,655,001 | B2 | 5/2017 | Metzger |
| 9,659,576 | B1 | 5/2017 | Kotvis |
| D789,323 | S | 6/2017 | Mackiewicz |
| 9,674,604 | B2 | 6/2017 | Deroo |
| 9,692,882 | B2 | 6/2017 | Mani |
| 9,706,057 | B2 | 7/2017 | Mani |
| 9,716,944 | B2 | 7/2017 | Yliaho |
| 9,721,582 | B1 | 8/2017 | Huang |
| 9,734,835 | B2 | 8/2017 | Fujieda |

(56) References Cited

U.S. PATENT DOCUMENTS

| | | | |
|---|---|---|---|
| 9,754,572 | B2 | 9/2017 | Salazar |
| 9,761,243 | B2 | 9/2017 | Taenzer |
| D801,285 | S | 10/2017 | Timmins |
| 9,788,119 | B2 | 10/2017 | Miikka |
| 9,813,806 | B2 | 11/2017 | Graham |
| 9,818,426 | B2 | 11/2017 | Kotera |
| 9,826,211 | B2 | 11/2017 | Sawa |
| 9,854,101 | B2 | 12/2017 | Pandey |
| 9,854,363 | B2 | 12/2017 | Sladeczek |
| 9,860,439 | B2 | 1/2018 | Sawa |
| 9,866,952 | B2 | 1/2018 | Pandey |
| D811,393 | S | 2/2018 | Ahn |
| 9,894,434 | B2 | 2/2018 | Rollow, IV |
| 9,930,448 | B1 | 3/2018 | Chen |
| 9,936,290 | B2 | 4/2018 | Mohammad |
| 9,973,848 | B2 | 5/2018 | Chhetri |
| 9,980,042 | B1 | 5/2018 | Benattar |
| D819,607 | S | 6/2018 | Chui |
| D819,631 | S | 6/2018 | Matsumiya |
| 10,021,506 | B2 | 7/2018 | Johnson |
| 10,021,515 | B1 | 7/2018 | Mallya |
| 10,034,116 | B2 | 7/2018 | Kadri |
| 10,054,320 | B2 | 8/2018 | Choi |
| 10,153,744 | B1 | 12/2018 | Every |
| 10,165,386 | B2 | 12/2018 | Lehtiniemi |
| D841,589 | S | 2/2019 | Andreas |
| 10,206,030 | B2 | 2/2019 | Matsumoto |
| 10,210,882 | B1 | 2/2019 | Mccowan |
| 10,231,062 | B2 | 3/2019 | Pedersen |
| 10,244,121 | B2 | 3/2019 | Mani |
| 10,244,219 | B2 | 3/2019 | Sawa |
| 10,269,343 | B2 | 4/2019 | Wingate |
| 10,367,948 | B2 | 7/2019 | Wells-Rutherford |
| D857,873 | S | 8/2019 | Shimada |
| 10,389,861 | B2 | 8/2019 | Mani |
| 10,389,885 | B2 | 8/2019 | Sun |
| D860,319 | S | 9/2019 | Beruto |
| D860,997 | S | 9/2019 | Jhun |
| D864,136 | S | 10/2019 | Kim |
| 10,440,469 | B2 | 10/2019 | Barnei, I |
| D865,723 | S | 11/2019 | Cho |
| 10,566,008 | B2 | 2/2020 | Thorpe |
| 10,602,267 | B2 | 3/2020 | Grosche |
| D883,952 | S | 5/2020 | Lucas |
| 10,650,797 | B2 | 5/2020 | Kumar |
| D888,020 | S | 6/2020 | Lyu |
| 10,728,653 | B2 | 7/2020 | Graham |
| D900,070 | S | 10/2020 | Lantz |
| D900,071 | S | 10/2020 | Lantz |
| D900,072 | S | 10/2020 | Lantz |
| D900,073 | S | 10/2020 | Lantz |
| D900,074 | S | 10/2020 | Lantz |
| 10,827,263 | B2 | 11/2020 | Christoph |
| 10,863,270 | B1 | 12/2020 | Cornelius |
| 10,930,297 | B2 | 2/2021 | Christoph |
| 10,959,018 | B1 | 3/2021 | Shi |
| 10,979,805 | B2 | 4/2021 | Chowdhary |
| D924,189 | S | 7/2021 | Park |
| 11,109,133 | B2 | 8/2021 | Lantz |
| D940,116 | S | 1/2022 | Cho |
| 2001/0031058 | A1 | 10/2001 | Anderson |
| 2002/0015500 | A1 | 2/2002 | Belt |
| 2002/0041679 | A1 | 4/2002 | Beaucoup |
| 2002/0048377 | A1 | 4/2002 | Vaudrey |
| 2002/0064158 | A1 | 5/2002 | Yokoyama |
| 2002/0064287 | A1 | 5/2002 | Kawamura |
| 2002/0069054 | A1 | 6/2002 | Arrowood |
| 2002/0110255 | A1 | 8/2002 | Killion |
| 2002/0126861 | A1 | 9/2002 | Colby |
| 2002/0131580 | A1 | 9/2002 | Smith |
| 2002/0140633 | A1 | 10/2002 | Rafii |
| 2002/0146282 | A1 | 10/2002 | Wilkes |
| 2002/0149070 | A1 | 10/2002 | Sheplak |
| 2002/0159603 | A1 | 10/2002 | Hirai |
| 2003/0026437 | A1 | 2/2003 | Janse |
| 2003/0053639 | A1 | 3/2003 | Beaucoup |
| 2003/0059061 | A1 | 3/2003 | Tsuji |
| 2003/0063762 | A1 | 4/2003 | Tajima |
| 2003/0063768 | A1 | 4/2003 | Cornelius |
| 2003/0072461 | A1 | 4/2003 | Moorer |
| 2003/0107478 | A1 | 6/2003 | Hendricks |
| 2003/0118200 | A1 | 6/2003 | Beaucoup |
| 2003/0122777 | A1 | 7/2003 | Grover |
| 2003/0138119 | A1 | 7/2003 | Pocino |
| 2003/0156725 | A1 | 8/2003 | Boone |
| 2003/0161485 | A1 | 8/2003 | Smith |
| 2003/0163326 | A1 | 8/2003 | Maase |
| 2003/0169888 | A1 | 9/2003 | Subotic |
| 2003/0185404 | A1 | 10/2003 | Milsap |
| 2003/0198339 | A1 | 10/2003 | Roy |
| 2003/0198359 | A1 | 10/2003 | Killion |
| 2003/0202107 | A1 | 10/2003 | Slattery |
| 2004/0013038 | A1 | 1/2004 | Kajala |
| 2004/0013252 | A1 | 1/2004 | Craner |
| 2004/0076305 | A1 | 4/2004 | Santiago |
| 2004/0105557 | A1 | 6/2004 | Matsuo |
| 2004/0125942 | A1 | 7/2004 | Beaucoup |
| 2004/0202345 | A1 | 10/2004 | Stenberg |
| 2004/0240664 | A1 | 12/2004 | Freed |
| 2005/0005494 | A1 | 1/2005 | Way |
| 2005/0041530 | A1 | 2/2005 | Goudie |
| 2005/0069156 | A1 | 3/2005 | Haapapuro |
| 2005/0094580 | A1 | 5/2005 | Kumar |
| 2005/0094795 | A1 | 5/2005 | Rambo |
| 2005/0149320 | A1 | 7/2005 | Kajala |
| 2005/0157897 | A1 | 7/2005 | Saltykov |
| 2005/0175189 | A1 | 8/2005 | Lee |
| 2005/0175190 | A1 | 8/2005 | Tashev |
| 2005/0213747 | A1 | 9/2005 | Popovich |
| 2005/0221867 | A1 | 10/2005 | Zurek |
| 2005/0238196 | A1 | 10/2005 | Furuno |
| 2005/0270906 | A1 | 12/2005 | Ramenzoni |
| 2005/0271221 | A1 | 12/2005 | Cerwin |
| 2005/0286698 | A1 | 12/2005 | Bathurst |
| 2005/0286729 | A1 | 12/2005 | Harwood |
| 2006/0083390 | A1 | 4/2006 | Kaderavek |
| 2006/0088173 | A1 | 4/2006 | Rodman |
| 2006/0093128 | A1 | 5/2006 | Oxford |
| 2006/0098403 | A1 | 5/2006 | Smith |
| 2006/0104458 | A1 | 5/2006 | Kenoyer |
| 2006/0109983 | A1 | 5/2006 | Young |
| 2006/0151256 | A1 | 7/2006 | Lee |
| 2006/0161430 | A1 | 7/2006 | Schweng |
| 2006/0165242 | A1 | 7/2006 | Miki |
| 2006/0192976 | A1 | 8/2006 | Hall |
| 2006/0204022 | A1 | 9/2006 | Hooley |
| 2006/0222187 | A1 | 10/2006 | Jarrett |
| 2006/0233353 | A1 | 10/2006 | Beaucoup |
| 2006/0239471 | A1 | 10/2006 | Mao |
| 2006/0262942 | A1 | 11/2006 | Oxford |
| 2006/0269080 | A1 | 11/2006 | Oxford |
| 2006/0269086 | A1 | 11/2006 | Page |
| 2007/0006474 | A1 | 1/2007 | Taniguchi |
| 2007/0009116 | A1 | 1/2007 | Reining |
| 2007/0019828 | A1 | 1/2007 | Hughes |
| 2007/0053524 | A1 | 3/2007 | Haulick |
| 2007/0093714 | A1 | 4/2007 | Beaucoup |
| 2007/0116255 | A1 | 5/2007 | Derkx |
| 2007/0120029 | A1 | 5/2007 | Keung |
| 2007/0165871 | A1 | 7/2007 | Roovers |
| 2007/0230712 | A1 | 10/2007 | Belt |
| 2007/0253561 | A1 | 11/2007 | Williams |
| 2007/0269066 | A1 | 11/2007 | Derleth |
| 2008/0008339 | A1 | 1/2008 | Ryan |
| 2008/0033723 | A1 | 2/2008 | Jang |
| 2008/0046235 | A1 | 2/2008 | Chen |
| 2008/0056517 | A1 | 3/2008 | Algazi |
| 2008/0101622 | A1 | 5/2008 | Sugiyama |
| 2008/0130907 | A1 | 6/2008 | Sudo |
| 2008/0144848 | A1 | 6/2008 | Buck |
| 2008/0168283 | A1 | 7/2008 | Penning |
| 2008/0188965 | A1 | 8/2008 | Bruey |
| 2008/0212805 | A1 | 9/2008 | Fincham |
| 2008/0232607 | A1 | 9/2008 | Tashev |

(56) References Cited

U.S. PATENT DOCUMENTS

| | | | |
|---|---|---|---|
| 2008/0247567 | A1 | 10/2008 | Morgan |
| 2008/0253553 | A1 | 10/2008 | Li |
| 2008/0253589 | A1 | 10/2008 | Trahms |
| 2008/0259731 | A1 | 10/2008 | Happonen |
| 2008/0260175 | A1 | 10/2008 | Elko |
| 2008/0279400 | A1 | 11/2008 | Knoll |
| 2008/0285772 | A1 | 11/2008 | Haulick |
| 2009/0003586 | A1 | 1/2009 | Lai |
| 2009/0030536 | A1 | 1/2009 | Gur |
| 2009/0052684 | A1 | 2/2009 | Ishibashi |
| 2009/0086998 | A1 | 4/2009 | Jeong |
| 2009/0087000 | A1 | 4/2009 | Ko |
| 2009/0094817 | A1 | 4/2009 | Killion |
| 2009/0129609 | A1 | 5/2009 | Oh |
| 2009/0147967 | A1 | 6/2009 | Ishibashi |
| 2009/0150149 | A1 | 6/2009 | Cutter |
| 2009/0161880 | A1 | 6/2009 | Hooley |
| 2009/0169027 | A1 | 7/2009 | Ura |
| 2009/0173030 | A1 | 7/2009 | Gulbrandsen |
| 2009/0173570 | A1 | 7/2009 | Levit |
| 2009/0226004 | A1 | 9/2009 | Moeller |
| 2009/0233545 | A1 | 9/2009 | Sutskover |
| 2009/0254340 | A1 | 10/2009 | Sun |
| 2009/0274318 | A1 | 11/2009 | Ishibashi |
| 2009/0310794 | A1 | 12/2009 | Ishibashi |
| 2010/0034397 | A1 | 2/2010 | Nakadai |
| 2010/0074433 | A1 | 3/2010 | Zhang |
| 2010/0111323 | A1 | 5/2010 | Marton |
| 2010/0111324 | A1 | 5/2010 | Yeldener |
| 2010/0119097 | A1 | 5/2010 | Ohtsuka |
| 2010/0123785 | A1 | 5/2010 | Chen |
| 2010/0128892 | A1 | 5/2010 | Chen |
| 2010/0128901 | A1 | 5/2010 | Herman |
| 2010/0131749 | A1 | 5/2010 | Kim |
| 2010/0142721 | A1 | 6/2010 | Wada |
| 2010/0150364 | A1 | 6/2010 | Buck |
| 2010/0158268 | A1 | 6/2010 | Marton |
| 2010/0165071 | A1 | 7/2010 | Toshiaki |
| 2010/0166219 | A1 | 7/2010 | Marton |
| 2010/0189275 | A1 | 7/2010 | Christoph |
| 2010/0189299 | A1 | 7/2010 | Grant |
| 2010/0202628 | A1 | 8/2010 | Meyer |
| 2010/0208605 | A1 | 8/2010 | Wang |
| 2010/0215184 | A1 | 8/2010 | Buck |
| 2010/0215189 | A1 | 8/2010 | Marton |
| 2010/0217590 | A1 | 8/2010 | Nemer |
| 2010/0246873 | A1 | 9/2010 | Chen |
| 2010/0284185 | A1 | 11/2010 | Ngai |
| 2010/0305728 | A1 | 12/2010 | Aiso |
| 2010/0314513 | A1 | 12/2010 | Evans |
| 2011/0002469 | A1 | 1/2011 | Ojala |
| 2011/0007921 | A1 | 1/2011 | Stewart |
| 2011/0033063 | A1 | 2/2011 | Mcgrath |
| 2011/0038229 | A1 | 2/2011 | Beaucoup |
| 2011/0096136 | A1 | 4/2011 | Liu |
| 2011/0096631 | A1 | 4/2011 | Kondo |
| 2011/0096915 | A1 | 4/2011 | Nemer |
| 2011/0164761 | A1 | 7/2011 | Mccowan |
| 2011/0194719 | A1 | 8/2011 | Frater |
| 2011/0211706 | A1 | 9/2011 | Tanaka |
| 2011/0235821 | A1 | 9/2011 | Okita |
| 2011/0268287 | A1 | 11/2011 | Ishibashi |
| 2011/0311064 | A1 | 12/2011 | Teutsch |
| 2011/0311085 | A1 | 12/2011 | Stewart |
| 2011/0317862 | A1 | 12/2011 | Hosoe |
| 2012/0002835 | A1 | 1/2012 | Stewart |
| 2012/0014049 | A1 | 1/2012 | Ogle |
| 2012/0027227 | A1 | 2/2012 | Kok |
| 2012/0076316 | A1 | 3/2012 | Zhu |
| 2012/0080260 | A1 | 4/2012 | Stewart |
| 2012/0093344 | A1 | 4/2012 | Sun |
| 2012/0117474 | A1 | 5/2012 | Miki |
| 2012/0128160 | A1 | 5/2012 | Kim |
| 2012/0128175 | A1 | 5/2012 | Erik |
| 2012/0155688 | A1 | 6/2012 | Wilson |
| 2012/0155703 | A1 | 6/2012 | Hernandez-Abrego |
| 2012/0163625 | A1 | 6/2012 | Siotis |
| 2012/0169826 | A1 | 7/2012 | Jeong |
| 2012/0177219 | A1 | 7/2012 | Mullen |
| 2012/0182429 | A1 | 7/2012 | Forutanpour |
| 2012/0207335 | A1 | 8/2012 | Spaanderman |
| 2012/0224709 | A1 | 9/2012 | Keddem |
| 2012/0243698 | A1 | 9/2012 | Elko |
| 2012/0262536 | A1 | 10/2012 | Chen |
| 2012/0288079 | A1 | 11/2012 | Burnett |
| 2012/0288114 | A1 | 11/2012 | Duraiswami |
| 2012/0294472 | A1 | 11/2012 | Hudson |
| 2012/0327115 | A1 | 12/2012 | Chhetri |
| 2012/0328142 | A1 | 12/2012 | Horibe |
| 2013/0002797 | A1 | 1/2013 | Thapa |
| 2013/0004013 | A1 | 1/2013 | Stewart |
| 2013/0015014 | A1 | 1/2013 | Stewart |
| 2013/0016847 | A1 | 1/2013 | Steiner |
| 2013/0028451 | A1 | 1/2013 | De Roo |
| 2013/0029684 | A1 | 1/2013 | Kawaguchi |
| 2013/0034241 | A1 | 2/2013 | Pandey |
| 2013/0039504 | A1 | 2/2013 | Pandey |
| 2013/0083911 | A1 | 4/2013 | Bathurst |
| 2013/0094689 | A1 | 4/2013 | Tanaka |
| 2013/0101141 | A1 | 4/2013 | Mcelveen |
| 2013/0136274 | A1 | 5/2013 | Per |
| 2013/0142343 | A1 | 6/2013 | Matsui |
| 2013/0147835 | A1 | 6/2013 | Lee |
| 2013/0156198 | A1 | 6/2013 | Kim |
| 2013/0182190 | A1 | 7/2013 | Mccartney |
| 2013/0206501 | A1 | 8/2013 | Yu |
| 2013/0216066 | A1 | 8/2013 | Yerrace |
| 2013/0226593 | A1 | 8/2013 | Magnusson |
| 2013/0251181 | A1 | 9/2013 | Stewart |
| 2013/0264144 | A1 | 10/2013 | Hudson |
| 2013/0271559 | A1 | 10/2013 | Feng |
| 2013/0294616 | A1 | 11/2013 | M?Lder |
| 2013/0297302 | A1 | 11/2013 | Pan |
| 2013/0304476 | A1 | 11/2013 | Kim |
| 2013/0304479 | A1 | 11/2013 | Teller |
| 2013/0329908 | A1 | 12/2013 | Lindahl |
| 2013/0332156 | A1 | 12/2013 | Tackin |
| 2013/0336516 | A1 | 12/2013 | Stewart |
| 2013/0343549 | A1 | 12/2013 | Vemireddy |
| 2014/0003635 | A1 | 1/2014 | Mohammad |
| 2014/0010383 | A1 | 1/2014 | Mackey |
| 2014/0016794 | A1 | 1/2014 | Lu |
| 2014/0029761 | A1 | 1/2014 | Maenpaa |
| 2014/0037097 | A1 | 2/2014 | Mark |
| 2014/0050332 | A1 | 2/2014 | Nielsen |
| 2014/0072151 | A1 | 3/2014 | Ochs |
| 2014/0098233 | A1 | 4/2014 | Martin |
| 2014/0098964 | A1 | 4/2014 | Rosca |
| 2014/0122060 | A1 | 5/2014 | Kaszczuk |
| 2014/0177857 | A1 | 6/2014 | Kuster |
| 2014/0233778 | A1 | 8/2014 | Hardiman |
| 2014/0264654 | A1 | 9/2014 | Salmon |
| 2014/0265774 | A1 | 9/2014 | Stewart |
| 2014/0270271 | A1 | 9/2014 | Dehe |
| 2014/0286518 | A1 | 9/2014 | Stewart |
| 2014/0295768 | A1 | 10/2014 | Wu |
| 2014/0301586 | A1 | 10/2014 | Stewart |
| 2014/0307882 | A1 | 10/2014 | Leblanc |
| 2014/0314251 | A1 | 10/2014 | Rosca |
| 2014/0341392 | A1 | 11/2014 | Lambert |
| 2014/0357177 | A1 | 12/2014 | Stewart |
| 2014/0363008 | A1 | 12/2014 | Chen |
| 2015/0003638 | A1 | 1/2015 | Kasai |
| 2015/0025878 | A1 | 1/2015 | Gowreesunker |
| 2015/0030172 | A1 | 1/2015 | Gaensler |
| 2015/0050967 | A1 | 2/2015 | Bao |
| 2015/0055796 | A1 | 2/2015 | Nugent |
| 2015/0055797 | A1 | 2/2015 | Nguyen |
| 2015/0070188 | A1 | 3/2015 | Aramburu |
| 2015/0078581 | A1 | 3/2015 | Etter |
| 2015/0078582 | A1 | 3/2015 | Graham |
| 2015/0097719 | A1 | 4/2015 | Balachandreswaran |
| 2015/0104023 | A1 | 4/2015 | Bilobrov |
| 2015/0117672 | A1 | 4/2015 | Christoph |

(56) References Cited

U.S. PATENT DOCUMENTS

2015/0118960 A1 4/2015 Petit
2015/0126255 A1 5/2015 Yang
2015/0156578 A1 6/2015 Alexandridis
2015/0163577 A1 6/2015 Benesty
2015/0185825 A1 7/2015 Mullins
2015/0189423 A1 7/2015 Giannuzzi
2015/0208171 A1 7/2015 Funakoshi
2015/0281832 A1 10/2015 Kishimoto
2015/0281833 A1 10/2015 Shigenaga
2015/0281834 A1 10/2015 Takano
2015/0312662 A1 10/2015 Kishimoto
2015/0312691 A1 10/2015 Jussi
2015/0326968 A1 11/2015 Shigenaga
2015/0341734 A1 11/2015 Sherman
2015/0350621 A1 12/2015 Sawa
2015/0358734 A1 12/2015 Butler
2016/0011851 A1 1/2016 Zhang
2016/0021478 A1 1/2016 Katagiri
2016/0029120 A1 1/2016 Nesta
2016/0031700 A1 2/2016 Sparks
2016/0037277 A1 2/2016 Matsumoto
2016/0055859 A1 2/2016 Finlow-Bates
2016/0080867 A1 3/2016 Nugent
2016/0088392 A1 3/2016 Huttunen
2016/0100092 A1 4/2016 Bohac
2016/0105473 A1 4/2016 Klingbeil
2016/0111109 A1 4/2016 Tsujikawa
2016/0127527 A1 5/2016 Mani
2016/0134928 A1 5/2016 Ogle
2016/0142548 A1 5/2016 Pandey
2016/0142814 A1 5/2016 Deroo
2016/0142815 A1 5/2016 Norris
2016/0148057 A1 5/2016 Oh
2016/0150315 A1 5/2016 Tzirkel-Hancock
2016/0150316 A1 5/2016 Kubota
2016/0155455 A1* 6/2016 Ojanpera ..... G10L 25/81 381/56
2016/0165340 A1 6/2016 Benattar
2016/0173976 A1 6/2016 Podhradsky
2016/0173978 A1 6/2016 Li
2016/0189727 A1 6/2016 Wu
2016/0196836 A1 7/2016 Yu
2016/0234593 A1 8/2016 Matsumoto
2016/0295279 A1 10/2016 Srinivasan
2016/0300584 A1 10/2016 Pandey
2016/0302002 A1 10/2016 Lambert
2016/0302006 A1 10/2016 Pandey
2016/0323667 A1 11/2016 Shumard
2016/0323668 A1 11/2016 Abraham
2016/0330545 A1 11/2016 Mcelveen
2016/0337523 A1 11/2016 Pandey
2016/0353200 A1 12/2016 Bigeh
2016/0357508 A1 12/2016 Moore
2017/0019744 A1 1/2017 Matsumoto
2017/0064451 A1 3/2017 Park
2017/0105066 A1 4/2017 Mclaughlin
2017/0134849 A1 5/2017 Pandey
2017/0134850 A1 5/2017 Graham
2017/0164101 A1 6/2017 Rollow, IV
2017/0180861 A1 6/2017 Chen
2017/0206064 A1 7/2017 Breazeal
2017/0230748 A1 8/2017 Shumard
2017/0264999 A1 9/2017 Fukuda
2017/0303887 A1 10/2017 Richmond
2017/0308352 A1 10/2017 Kessler
2017/0374454 A1 12/2017 Bernardini
2018/0083848 A1 3/2018 Siddiqi
2018/0102136 A1 4/2018 Ebenezer
2018/0109873 A1 4/2018 Xiang
2018/0115799 A1 4/2018 Thiele
2018/0160224 A1 6/2018 Graham
2018/0196585 A1 7/2018 Densham
2018/0219922 A1 8/2018 Bryans
2018/0227666 A1 8/2018 Barnei, I
2018/0292079 A1 10/2018 Branham
2018/0310096 A1 10/2018 Shumard
2018/0313558 A1 11/2018 Byers
2018/0359565 A1 12/2018 Kim
2019/0042187 A1 2/2019 Truong
2019/0166424 A1 5/2019 Harney
2019/0215540 A1 7/2019 Nicol
2019/0230436 A1 7/2019 Tsingos
2019/0259408 A1 8/2019 Freeman
2019/0268683 A1 8/2019 Miyahara
2019/0295540 A1 9/2019 Grima
2019/0295569 A1 9/2019 Wang
2019/0319677 A1 10/2019 Hansen
2019/0371354 A1 12/2019 Lester
2019/0373362 A1 12/2019 Ansai
2019/0385629 A1 12/2019 Moravy
2019/0387311 A1 12/2019 Schultz
2020/0015021 A1 1/2020 Leppanen
2020/0021910 A1 1/2020 Rollow, IV
2020/0037068 A1 1/2020 Barnei, I
2020/0100009 A1 3/2020 Lantz
2020/0100025 A1 3/2020 Shumard
2020/0137485 A1 4/2020 Yamakawa
2020/0145753 A1 5/2020 Rollow, IV
2020/0152218 A1 5/2020 Kikuhara
2020/0162618 A1 5/2020 Enteshari
2020/0228663 A1 7/2020 Wells-Rutherford
2020/0251119 A1 8/2020 Yang
2020/0275204 A1 8/2020 Labosco
2020/0278043 A1 9/2020 Cao
2020/0288237 A1 9/2020 Abraham
2021/0012789 A1 1/2021 Husain
2021/0021940 A1 1/2021 Petersen
2021/0044881 A1 2/2021 Lantz
2021/0051397 A1 2/2021 Veselinovic
2021/0098014 A1 4/2021 Tanaka
2021/0098015 A1 4/2021 Pandey
2021/0120335 A1 4/2021 Veselinovic
2021/0200504 A1 7/2021 Park
2021/0375298 A1 12/2021 Zhang

FOREIGN PATENT DOCUMENTS

CA 2505496 10/2006
CA 2838856 12/2012
CA 2838856 A1 12/2012
CA 2846323 9/2014
CA 2846323 A1 9/2014
CN 1780495 5/2006
CN 101217830 7/2008
CN 101833954 9/2010
CN 101860776 10/2010
CN 101894558 11/2010
CN 102646418 8/2012
CN 102821336 12/2012
CN 102833664 12/2012
CN 102833664 A 12/2012
CN 102860039 1/2013
CN 104036784 9/2014
CN 104053088 9/2014
CN 104080289 10/2014
CN 104080289 A 10/2014
CN 104347076 2/2015
CN 104581463 4/2015
CN 105355210 2/2016
CN 105548998 5/2016
CN 106162427 11/2016
CN 106251857 12/2016
CN 106851036 6/2017
CN 107221336 9/2017
CN 107534725 1/2018
CN 108172235 6/2018
CN 109087664 12/2018
CN 208190895 12/2018
CN 109727604 5/2019
CN 110010147 7/2019
CN 306391029 3/2021
DE 2941485 4/1981
EM 3077546430001 3/2020
EP 0381498 8/1990

(56) References Cited

FOREIGN PATENT DOCUMENTS

| | | | |
|---|---|---|---|
| EP | 3594098 | | 4/1994 |
| EP | 3869697 | | 10/1998 |
| EP | 1180914 | | 2/2002 |
| EP | 1184676 | | 3/2002 |
| EP | 3944228 | | 6/2003 |
| EP | 1439526 | | 7/2004 |
| EP | 1651001 | | 4/2006 |
| EP | 1727344 | | 11/2006 |
| EP | 1906707 | | 4/2008 |
| EP | 1952393 | | 8/2008 |
| EP | 1962547 | | 8/2008 |
| EP | 2133867 | | 12/2009 |
| EP | 2159789 | | 3/2010 |
| EP | 2197219 | | 6/2010 |
| EP | 2360940 | | 8/2011 |
| EP | 2710788 | | 3/2014 |
| EP | 2721837 | | 4/2014 |
| EP | 2721837 | A1 | 4/2014 |
| EP | 277831 | | 9/2014 |
| EP | 2772910 | | 9/2014 |
| EP | 2778310 | | 9/2014 |
| EP | 2942975 | | 11/2015 |
| EP | 2988527 | | 2/2016 |
| EP | 3131311 | | 2/2017 |
| GB | 2393601 | | 3/2004 |
| GB | 2446620 | | 8/2008 |
| JP | S63144699 | | 6/1988 |
| JP | 01260967 | | 10/1989 |
| JP | H01260967 | | 10/1989 |
| JP | H0241099 | | 2/1990 |
| JP | H07336790 | | 12/1995 |
| JP | 2518823 | | 7/1996 |
| JP | 3175622 | | 6/2001 |
| JP | 2003060530 | | 2/2003 |
| JP | 2003087890 | | 3/2003 |
| JP | 2004349806 | | 12/2004 |
| JP | 2004537232 | | 12/2004 |
| JP | 2005323084 | | 11/2005 |
| JP | 2006094389 | | 4/2006 |
| JP | 2006101499 | | 4/2006 |
| JP | 1120646 | | 8/2006 |
| JP | 1258472 | | 8/2006 |
| JP | 1196956 | | 9/2006 |
| JP | 2006340151 | | 12/2006 |
| JP | 1760160 | | 1/2007 |
| JP | 1752403 | | 3/2007 |
| JP | 2007089058 | | 4/2007 |
| JP | 1867579 | | 6/2007 |
| JP | 2007208503 | | 8/2007 |
| JP | 2007228069 | | 9/2007 |
| JP | 2007228070 | | 9/2007 |
| JP | 2007274131 | | 10/2007 |
| JP | 2007274463 | | 10/2007 |
| JP | 2007288679 | | 11/2007 |
| JP | 2008005347 | | 1/2008 |
| JP | 2008042754 | | 2/2008 |
| JP | 5028944 | | 5/2008 |
| JP | 2008154056 | | 7/2008 |
| JP | 2008259022 | | 10/2008 |
| JP | 2008263336 | | 10/2008 |
| JP | 2008312002 | | 12/2008 |
| JP | 2009206671 | | 9/2009 |
| JP | 2010028653 | | 2/2010 |
| JP | 2010114554 | | 5/2010 |
| JP | 2010268129 | | 11/2010 |
| JP | 2011015018 | | 1/2011 |
| JP | 1779748 | | 9/2011 |
| JP | 5139111 | | 2/2013 |
| JP | 5306565 | | 10/2013 |
| JP | 5685173 | | 3/2015 |
| JP | 2016051038 | | 4/2016 |
| KR | 100298300 | | 5/2001 |
| KR | 100960781 | | 1/2004 |
| KR | 100901464 | | 6/2009 |
| KR | 1020130033723 | | 4/2013 |
| KR | 300856915 | | 5/2016 |
| TW | 201331932 | | 8/2013 |
| TW | 484478 | | 5/2015 |
| WO | 1997008896 | | 3/1997 |
| WO | 1998047291 | | 10/1998 |
| WO | 2000030402 | | 5/2000 |
| WO | 2003073786 | | 9/2003 |
| WO | 2003088429 | | 10/2003 |
| WO | 2004027754 | | 4/2004 |
| WO | 2004090865 | | 10/2004 |
| WO | 2006049260 | | 5/2006 |
| WO | 2006071119 | | 7/2006 |
| WO | 2006114015 | | 11/2006 |
| WO | 2006121896 | | 11/2006 |
| WO | 2007045971 | | 4/2007 |
| WO | 2008074249 | | 6/2008 |
| WO | 2008125523 | | 10/2008 |
| WO | 2009039783 | | 4/2009 |
| WO | 2009109069 | | 9/2009 |
| WO | 2010001508 | | 1/2010 |
| WO | 2010091999 | | 8/2010 |
| WO | 2010140084 | | 12/2010 |
| WO | 2010144148 | | 12/2010 |
| WO | 2010144148 | A2 | 12/2010 |
| WO | 2011104501 | | 9/2011 |
| WO | 2012122132 | | 9/2012 |
| WO | 2012140435 | | 10/2012 |
| WO | 2012160459 | | 11/2012 |
| WO | 2012174159 | | 12/2012 |
| WO | 2012174159 | A1 | 12/2012 |
| WO | 2013016986 | | 2/2013 |
| WO | 2013182118 | | 12/2013 |
| WO | 2014156292 | | 10/2014 |
| WO | 2016176429 | | 11/2016 |
| WO | 2016179211 | | 11/2016 |
| WO | 2017208022 | | 12/2017 |
| WO | 2018140444 | | 8/2018 |
| WO | 2018140618 | | 8/2018 |
| WO | 2018211806 | | 11/2018 |
| WO | 2019231630 | | 12/2019 |
| WO | 2020168873 | | 8/2020 |
| WO | 2020191354 | | 9/2020 |
| WO | 211843001 | | 11/2020 |

OTHER PUBLICATIONS

Powers, et al., "Proving Adaptive Directional Technology Works: A Review of Studies," The Hearing Review, Apr. 6, 2004, 5 pp.

CTG Audio, White on White - Introducing the CM-02 Ceiling Microphone, https://ctgaudio.com/white-on-white-ntroducing-the-cm-02-ceiling-microphone/, Feb. 20, 2014, 3 pgs.

Dahl et al., Acoustic Echo Cancelling with Microphone Arrays, Research Report 3/95, Univ, of Kariskrona/Ronneby, Apr. 1995, 64 pgs.

Desiraju et al., Efficient Multi-Channel Acoustic Echo Cancellation Using Constrained Sparse Filter Updates in the Subband Domain, ITG-Fachbericht 252: Speech Communication, Sep. 2014,4 pgs.

Dibiase et al., Robust Localization in Reverberent Rooms, in Brandstein, ed., Microphone Arrays: Techniques and Applications, 2001, Springer-Verlag Berlin Heidelberg, pp. 157-180.

Do et al., A Real-Time SRP-PHAT Source Location Implementation using Stochastic Region Contraction (SRC) on a Large-Aperture Microphone Array, 2007 IEEE International Conference on Acoustics, Speech and Signal Processing -CASSP '07,, Apr. 2007, pp. 1-121 - 1-124.

Fan et al., Localization Estimation of Sound Source by Microphones Array, Procedia Engineering 7, 2010, pp. 312-317.

Flanagan et al., Autodirective Microphone Systems, Acustica, vol. 73, 1991, pp. 58-71.

Flanagan et al., Computer-Steered Microphone Arrays for Sound Transduction in Large Rooms, J. Acoust. Soc. Am. 78 (5), Nov. 1985, pp. 1508-1518.

Frost, III, An Algorithm for Linearly Constrained Adaptive Array Processing, Proc. IEEE, vol. 60, No. 8, Aug. 1972, pp. 926-935.

Gannot et al., Signal Enhancement using Beamforming and Nonstationarity with Applications to Speech, IEEE Trans. Dn Signal Processing, vol. 49, No. 8, Aug. 2001, pp. 1614-1626.

(56) References Cited

OTHER PUBLICATIONS

Gansler et al., A Double-Talk Detector Based on Coherence, IEEE Transactions on Communications, vol. 44, No. 11, Mov. 1996, pp. 1421-1427.
Gazor et al., Robust Adaptive Beamforming via Target Tracking, IEEE Transactions on Signal Processing, vol. 44, No. 3, Jun. 1996, pp. 1589-1593.
Gazor et al., Wideband Multi-Source Beamforming with Adaptive Array Location Calibration and Direction Finding, 1995 International Conference on Acoustics, Speech, and Signal Processing, May 1995, pp. 1904-1907.
Gentner Communications Corp., AP400 Audio Perfect 400 Audioconferencing System Installation & Operation Manual, Mov. 1998, 80 pgs.
Gentner Communications Corp., XAP 800 Audio Conferencing System Installation & Operation Manual, Oct. 2001, 152 ?gs.
Gil-Cacho et al., Multi-Microphone Acoustic Echo Cancellation Using Multi-Channel Warped Linear Prediction of Common Acoustical Poles, 18th European Signal Processing Conference, Aug. 2010, pp. 2121-2125.
Gritton et al., Echo Cancellation Algorithms, IEEE Assp Magazine, vol. 1, issue 2, Apr. 1984, pp. 30-38.
Hamalainen et al., Acoustic Echo Cancellation for Dynamically Steered Microphone Array Systems, 2007 IEEE Workshop on Applications of Signal Processing to Audio and Acoustics, Oct. 2007, pp. 58-61.
Herbordt et al., A Real-time Acoustic Human-Machine Front-End for Multimedia Applications Integrating Robust Adaptive Beamforming and Stereophonic Acoustic Echo Cancellation, 7th International Conference on Spoken Language Processing, Sep. 2002,4 pgs.
Herbordt et al., GSAEC - Acoustic Echo Cancellation embedded into the Generalized Sidelobe Canceller, 10th European Signal Processing Conference, Sep. 2000, 5 pgs.
Herbordt et al., Multichannel Bin-Wise Robust Frequency-Domain Adaptive Filtering and Its Application to Adaptive Beamforming, IEEE Transactions on Audio, Speech, and Language Processing, vol. 15, No. 4, May 2007, pp. 1340-1351.
Herbordt, Combination of Robust Adaptive Beamforming with Acoustic Echo Cancellation for Acoustic Human/Machine nterfaces, Friedrich-Alexander University, 2003, 293 pgs.
Herbordt, et al., Joint Optimization of LCMV Beamforming and Acoustic Echo Cancellation for Automatic Speech Recognition, IEEE International Conference on Acoustics, Speech, and Signal Processing, Mar. 2005, pp. 111-177 -11-80.
Huang et al., Immersive Audio Schemes: The Evolution of Multiparty Teleconferencing, IEEE Signal Processing Magazine, Jan. 2011, pp. 20-32.
International Search Report and Written Opinion for PCT/US2016/029751 dated Nov. 28, 2016, 21 pp.
NvenSense Inc., Microphone Array Beamforming, Dec. 31, 2013, 12 pgs.
Shii et al., Investigation on Sound Localization using Multiple Microphone Arrays, Reflection and Spatial Information, Japanese Society for Artificial Intelligence, JSAI Technical Report, SIG Challenge B202 11, 2012, pp. 64-69.
To et al., Aerodynamic/Aeroacoustic Testing in Anechoic Closed Test Sections of Low-speed Wind Tunnels, 16th AIAA/CEAS Aeroacoustics Conference, 2010, 11 pgs.
Johansson et al., Robust Acoustic Direction of Arrival Estimation using Root-SRP-PHAT, a Realtime Implementation, EEE International Conference on Acoustics, Speech, and Signal Processing, Mar. 2005,4 pgs.
Johansson, et al., Speaker Localisation using the Far-Field SRP-PHAT in Conference Telephony, 2002 International Symposium on Intelligent Signal Processing and Communication Systems, 5 pgs.
Julstrom et al., Direction-Sensitive Gating: A New Approach to Automatic Mixing, J. Audio Eng. Soc., vol. 32, No. 7/8, July/Aug. 1984, pp. 490-506.
Kahrs, Ed., The Past, Present, and Future of Audio Signal Processing, IEEE Signal Processing Magazine, Sep. 1997, op. 30-57.
Kallinger et al., Multi-Microphone Residual Echo Estimation, 2003 IEEE International Conference on Acoustics, Speech, and Signal Processing, Apr. 2003,4 pgs.
Kammeyer, et al., New Aspects of Combining Echo Cancellers with Beamformers, IEEE International Conference on Acoustics, Speech, and Signal Processing, Mar. 2005, pp. 111-137 -111-140.
Kellermann, A Self-Steering Digital Microphone Array, 1991 International Conference on Acoustics, Speech, and Signal Processing, Apr. 1991, pp. 3581-3584.
Kellermann, Acoustic Echo Cancellation for Beamforming Microphone Arrays, in Brandstein, ed.. Microphone Arrays Techniques and Applications, 2001, Springer-Verlag Berlin Heidelberg, pp. 281-306.
Kellermann, Integrating Acoustic Echo Cancellation with Adaptive Beamforming Microphone Arrays, Forum Acusticum, Berlin, Mar. 1999, pp. 1-4.
Kellermann, Strategies for Combining Acoustic Echo Cancellation and Adaptive Beamforming Microphone Arrays, 1997 IEEE International Conference on Acoustics, Speech, and Signal Processing, Apr. 1997, 4 pgs.
Knapp, et al., The Generalized Correlation Method for Estimation of Time Delay, IEEE Transactions on Acoustics, Speech, and Signal Processing, vol. ASSP-24, No. 4, Aug. 1976, pp. 320-327.
Kobayashi et al., A Hands-Free Unit with Noise Reduction by Using Adaptive Beamformer, IEEE Transactions on Consumer Electronics, vol. 54, No. 1, Feb. 2008, pp. 116-122.
Kobayashi et al., A Microphone Array System with Echo Canceller, Electronics and Communications in Japan, Part 3, vol. 89, No. 10, Feb. 2, 2006, pp. 23-32.
Lebret, et al., Antenna Array Pattern Synthesis via Convex Cptimization, IEEE Trans, on Signal Processing, vol. 45, No. 3, Mar. 1997, pp. 526-532.
Lectrosonics, LecNet2 Sound System Design Guide, Jun. 2006,28 pgs.
Lee et al., Multichannel Teleconferencing System with Multispatial Region Acoustic Echo Cancellation, International Workshop on Acoustic Echo and Noise Control (IWAENC2003), Sep. 2003, pp. 51-54.
Lindstrom et al., An Improvement of the Two-Path Algorithm Transfer Logic for Acoustic Echo Cancellation, IEEE Transactions on Audio, Speech, and Language Processing, vol. 15, No. 4, May 2007, pp. 1320-1326.
Liu et al., Adaptive Beamforming with Sidelobe Control: A Second-Order Cone Programming Approach, IEEE Signal Proc Letters, vol. 10, No. 11, Nov. 2003, pp. 331-334.
Lobo, et al., Applications of Second-Order Cone Programming, Linear Algebra and its Applications 284, 1998, pp. 193-228.
Luo et al., Wideband Beamforming with Broad Nulls of Nested Array, Third Int'l Conf, on Info. Science and Tech., Mar. 23-25, 2013, pp. 1645-1648.
Marquardt et al., A Natural Acoustic Front-End for Interactive TV in the EU-Project Digit, IEEE Pacific Rim Conference on Communications, Computers and Signal Processing, Aug. 2009, pp. 894-899.
Martin, Small Microphone Arrays with Postfilters for Noise and Acoustic Echo Reduction, in Brandstein, ed., Microphone Arrays: Techniques and Applications, 2001, Springer-Veriag Berlin Heidelberg, pp. 255-279.
Maruo et al.. On the Optimal Solutions of Beamfomner Assisted Acoustic Echo Cancellers, IEEE Statistical Signal Processing Workshop, 2011, pp. 641-644.
Mccowan, Microphone Arrays: A Tutorial, Apr. 2001, 36 pgs.
Mohammed, A New Adaptive Beamformer for Optimal Acoustic Echo and Noise Cancellation with Less Computational Load, Canadian Conference on Electrical and Computer Engineering, May 2008, p. 000123-000128.
Mohammed, A New Robust Adaptive Beamformer for Enhancing Speech Corrupted with Colored Noise, AICCSA, Apr. 2008, pp. 508-515.
Mohammed, Real-time Implementation of an efficient RLS Algorithm based on HR Filter for Acoustic Echo Cancellation, AICCSA, Apr. 2008, pp. 489-494.

(56) References Cited

OTHER PUBLICATIONS

Myllyla et al., Adaptive Beamforming Methods for Dynamically Steered Microphone Array Systems, 2008 IEEE International Conference on Acoustics, Speech and Signal Processing, Mar.-Apr. 2008, pp. 305-308.
Nguyen-Ky et al., An Improved Error Estimation Algorithm for Sterephonic Acoustic Echo Cancellation Systems, 1st International Conference on Signal Processing and Communication Systems, Dec. 2007, 5 pgs.
Dh et al., Hands-Free Voice Communication in an Automobile With a Microphone Array, 1992 IEEE International Conference on Acoustics, Speech, and Signal Processing, Mar. 1992, pp. 1-281-1-284.
Dmologo, Multi-Microphone Signal Processing for Distant-Speech Interaction, Human Activity and Vision Summer School (Havss), Inria Sophia Antipolis, Oct. 3, 2012, 79 pgs.
Pados et al., An Iterative Algorithm for the Computation of the MVDR Filter, IEEE Trans. On Signal Processing, vol. 49 no. 2, Feb. 2001, pp. 290-300.
Pettersen, Broadcast Applications for Voice-Activated Microphones, db, July/Aug. 1985, 6 pgs.
Plascore, PCGA-XR1 3003 Aluminum Honeycomb Data Sheet, 2008, 2 pgs.
Polycom Inc., Vortex EF2211/EF2210 Reference Manual, 2003, 66 pgs.
Polycom, Inc., Polycom Soundstructure C16, C12, C8, and SR12 Design Guide, Nov. 2013, 743 pgs.
Polycom, Inc., Setting Up the Polycom HDX Ceiling Microphone Array Series, https://support.polycom.com/content/Jam/polycom-support/products/Telepresence-and-Video/HDX%20Series/setup-maintenance/en/ndx_ceiling_microphone_array_setting_up.pdf, 2010, 16 pgs.
Polycom, Inc., Vortex EF2241 Reference Manual, 2002, 68 pgs.
Powers, Proving Adaptive Directional Technology Works: A Review of Studies, The Hearing Review, http://www. hearingreview.com/2004/04/proving-adaptive-directional-technology-works-a-review-of-studies/, Apr. 2004, 8 pgs.
Rabinkin et al., Estimation of Wavefront Arrival Delay Using the Cross-Power Spectrum Phase Technique, 132nd Meeting of the Acoustical Society of America, Dec. 1996, pp. 1-10.
Rane Corp., Halogen Acoustic Echo Cancellation Guide, AEC Guide Version 2, Nov. 2013,16 pgs.
Rao et al., Fast LMS/Newton Algorithms for Sterophonic Acoustic Echo Cancellation, IEEE Transactions on Signal Processing, vol. 57, No. 8, Aug. 2009, pp. 2919-2930.
Reuven et al., Joint Acoustic Echo Cancellation and Transfer Function GSC in the Frequency Domain, 23rd IEEE Convention of Electrical and Electronics Engineers in Israel, Sep. 2004, pp. 412-415.
Reuven et al., Joint Noise Reduction and Acoustic Echo Cancellation Using the Transfer-Function Generalized Sidelobe Canceller, Speech Communication, vol. 49,2007, pp. 623-635.
Reuven et al., Multichannel Acoustic Echo Cancellation and Noise Reduction in Reverberant Environments Using the Transfer-Function GSC, 2007 IEEE International Conference on Acoustics, Speech and Signal Processing - ICASSP 07, Apr. 2007, pp. 1-81 -1-84.
Ristimaki, Distributed Microphone Array System for Two-Way Audio Communication, Helsinki Univ, of Technology, Master's Thesis, Jun. 15, 2009, 73 pgs.
Rombouts et al., An Integrated Approach to Acoustic Noise and Echo Cancellation, Signal Processing 85, 2005, pp. 349-871.
Sasaki et al., A Predefined Command Recognition System Using a Ceiling Microphone Array in Noisy Housing Environments, 2008 IEEE/RSJ International Conference on Intelligent Robots and Systems, Sep. 2008, pp. 2178-2184.
Sennheiser, New microphone solutions for ceiling and desk installation, https://en-US.sennheiser.com/news-new-microphone-solutions-for-ceiling-and-desk-installation, Feb. 2011,2 pgs.
Sennheiser, TeamConnect Ceiling, https://en-US.sennheiser.com/conference-meeting-rooms-teamconnect-ceiling, 7 ogs.
Shure AMS Update, vol. 1, No. 1, 1983, 2 pgs.
Shure AMS Update, vol. 1, No. 2, 1983, 2 pgs.
Shure AMS Update, vol. 4, No. 4, 1997, 8 pgs.
Shure Inc., Microflex Advance, http://www.shure.com/americas/microflex-advance, 12 pgs.
Shure Inc., MX395 Low Profile Boundary Microphones, 2007, 2 pgs.
Shure Inc., MXA910 Ceiling Array Microphone, http://www.shure.com/americas/products/microphones/microflex-advance/mxa910-ceiling-array-microphone, 7 pgs.
Silverman et al., Performance of Real-Time Source-Location Estimators for a Large-Aperture Microphone Array, IEEE Transactions on Speech and Audio Processing, vol. 13, No. 4, Jul. 2005, pp. 593-606.
Sinha, Ch. 9: Noise and Echo Cancellation, in Speech Processing in Embedded Systems, Springer, 2010, pp. 127-142.
Soda et al., Introducing Multiple Microphone Arrays for Enhancing Smart Home Voice Control, The Institute of Electronics, Information and Communication Engineers, Technical Report of IEICE, Jan. 2013, 6 pgs.
Symetrix, Inc., SymNet Network Audio Solutions Brochure, 2008, 32 pgs.
Tandon et al., An Efficient, Low-Complexity, Normalized LMS Algorithm for Echo Cancellation, 2nd Annual IEEE Northeast Workshop on Circuits and Systems, Jun. 2004, pp. 161-164.
Tetelbaum et al., Design and Implementation of a Conference Phone Based on Microphone Array Technology, Proc. Global Signal Processing Conference and Expo (GSPx), Sep. 2004, 6 pgs.
Tiete et al., SoundCompass: A Distributed MEMS Microphone Array-Based Sensor for Sound Source Localization, SENSORS, Jan. 23, 2014, pp. 1918-1949.
TOACorp., Ceiling Mount Microphone AN-9001 Operating Instructions, http://www.toaelectronics.com/media/an9001_mt1e.pdf, 1 pg.
Van Compemolle, Switching Adaptive Filters for Enhancing Noisy and Reverberant Speech from Microphone Array Recordings, Proc IEEE Int Conf on Acoustics, Speech, and Signal Processing, Apr. 1990, pp. 833-836.
Van Trees, Optimum Array Processing: Part IV of Detection, Estimation, and Modulation Theory, 2002, 54 pgs., pp. i-xxv, 90-95, 201-230.
Van Veen et al., Beamforming: A Versatile Approach to Spatial Filtering, IEEE Assp Magazine, vol. 5, issue 2, Apr. 1988, pp. 4-24.
Nang et al., Combining Superdirective Beamforming and Frequency-Domain Blind Source Separation for Highly Reverberant Signals, EURASIP Journal on Audio, Speech, and Music Processing, vol. 2010, pp. 1-13.
Weinstein et al., Loud: A 1020-Node Microphone Array and Acoustic Beamformer, 14th International Congress on Sound & Vibration, Jul. 2007, 8 pgs.
Wung, A System Approach to Multi-Channel Acoustic Echo Cancellation and Residual Echo Suppression for Robust Hands-Free Teleconferencing, Georgia Institute of Technology, May 2015, 167 pgs.
Tamaha Corp., MRX7-D Signal Processor Product Specifications, 2016,12 pgs.
Tamaha Corp., PJP-100H Ip Audio Conference System Owner's Manual, Sep. 2006, 59 pgs.
Yamaha Corp., PJP-EC200 Conference Echo Canceller, Oct. 2009,2 pgs.
Kan et al., Convex Optimization Based Time-Domain Broadband Beamforming with Sidelobe Control, Journal of the Acoustical Society of America, vol. 121, No. 1, Jan. 2007, pp. 46-49.
Yensen et al., Synthetic Stereo Acoustic Echo Cancellation Structure with Microphone Array Beamforming for VOIP Conferences, 2000 IEEE International Conference on Acoustics, Speech, and Signal Processing, Jun. 2000, pp. 317-820.
Zhang et al., Multichannel Acoustic Echo Cancellation in Multiparty Spatial Audio Conferencing with Constrained Kalman Filtering, 11th International Workshop on Acoustic Echo and Noise Control, Sep. 2008, 4 pgs.
Zhang et al., Selective Frequency Invariant Uniform Circular Broadband Beamformer, EURASIP Journal on Advances n Signal Processing, vol. 2010, pp. 1-11.

(56) References Cited

OTHER PUBLICATIONS

Zheng et al., Experimental Evaluation of a Nested Microphone Array with Adaptive Noise Cancellers, IEEE Transactions on Instrumentation and Measurement, vol. 53, No. 3, Jun. 2004, pg ///-786.
Advanced Network Devices, IPSCM Ceiling Tile IP Speaker, Feb. 2011, 2 pgs.
Advanced Network Devices, IPSCM Standard 2' by 2' Ceiling Tile Speaker, 2 pgs.
Affes et al., A Signal Subspace Tracking Algorithm for Microphone Array Processing of Speech, IEEE Trans. On Speech and Audio Processing, vol. 5, No. 5, Sep. 1997, pp. 425-437.
Affes et al., A Source Subspace Tracking Array of Microphones for Double Talk Situations, 1996 IEEE International Conference on Acoustics, Speech, and Signal Processing Conference Proceedings, May 1996, pp. 909-912.
Affes et al.. An Algorithm for Multisource Beamforming and Multitarget Tracking, IEEE Trans. On Signal Processing, vol. 44, No. 6, Jun. 1996, pp. 1512-1522.
Affes et al.. Robust Adaptive Beamforming via LMS-Like Target Tracking, Proceedings of IEEE International Conference on Acoustics, Speech and Signal Processing, Apr. 1994, pp. IV-269-IV-272.
Armstrong World Industries, Inc., I-Ceilings Sound Systems Speaker Panels, 2002,4 pgs.
Arnold et al., A Directional Acoustic Array Using Silicon Micromachined Piezoresistive Microphones, Journal of the Acoustical Society of America, 113(1), Jan. 2003, pp. 289-298.
Arnold, et al., "A directional acoustic array using silicon micromachined piezoresistive microphones," Journal of Acoustical Society of America, 113 (1), pp. 289-298, Jan. 2003 (10 p. ).
Atlas Sound, I128SYSM Ip Compliant Loudspeaker System with Microphone Data Sheet, 2009,2 pgs.
Atlas Sound, 1'X2' Ip Speaker with Micophone for Suspended Ceiling Systems, https://www.atlasied.com/i128sysm, Yetrieved Oct. 25, 2017, 5 pgs.
Audio Technica, ES945 Omnidirectional Condenser Boundary Microphones, https://eu.audio-technica.com/resources/ES945%20Specifications.pdf, 2007,1 pg.
Audix Microphones, Audix Introduces Innovative Ceiling Mies, http://audixusa.com/docs_12/latest_news/EFpIFkAAklOtSdolke.shtml, Jun. 2011, 6 pgs.
Audix Microphones, M70 Flush Mount Ceiling Mic, May 2016, 2 pgs.
Beh et al., Combining Acoustic Echo Cancellation and Adaptive Beamforming for Achieving Robust Speech Interface n Mobile Robot, 2008 IEEE/RSJ International Conference on Intelligent Robots and Systems, Sep. 2008, pp. 1693-1698.
Benesty et al., A New Class of Doubletalk Detectors Based on Cross-Correlation, IEEE Transactions on Speech and Audio Processing, vol. 8, No. 2, Mar. 2000, pp. 168-172.
Benesty et al., Adaptive Algorithms for Mimo Acoustic Echo Cancellation, https://publik.tuwien.ac.at/files/pub-et 9085. odf, 2003, pp. 1-30.
Benesty et al., Frequency-Domain Adaptive Filtering Revisited, Generalization to the Multi-Channel Case, and Application to Acoustic Echo Cancellation, 2000 IEEE International Conference on Acoustics, Speech, and Signal Processing Proceedings, Jun. 2000, pp. 789-792.
Beyer Dynamic, Classis BM 32-33-34 DE-EN-FR 2016, 1 pg.
Beyer Dynamic, Classis-BM- 33-PZ A1, 1 pg.
Boyd, et al., Convex Optimization, Mar. 15, 1999,216 pgs.
Brandstein et al., Eds., Microphone Arrays: Signal Processing Techniques and Applications, Digital Signal Processing, Springer-Verlag Berlin Heidelberg, 2001,401 pgs.
Bruel & Kjaer, by J.J. Christensen and J. Hald, Technical Review: Beamforming, No. 1, 2004, 54 pgs.
BSS Audio, Soundweb London Application Guides, 2010, 120 pgs.
Buchner et al., An Acoustic Human-Machine Interface with Multi-Channel Sound Reproduction, IEEE Fourth Workshop on Multimedia Signal Processing, Oct. 2001, pp. 359-364.
Buchner et al., Full-Duplex Communication Systems Using Loudspeaker Arrays and Microphone Arrays, IEEE International Conference on Multimedia and Expo, Aug. 2002, pp. 509-512.
Buchner et al., An Efficient Combination of Multi-Channel Acoustic Echo Cancellation with a Beamforming Microphone Array, International Workshop on Hands-Free Speech Communication (HSC2001), Apr. 2001, pp. 55-58.
Buchner et al., Generalized Multichannel Frequency-Domain Adaptive Filtering: Efficient Realization and Application to Hands-Free Speech Communication, Signal Processing 85, 2005, pp. 549-570.
Buchner et al., Multichannel Frequency-Domain Adaptive Filtering with Application to Multichannel Acoustic Echo Cancellation, Adaptive Signal Processing, 2003, pp. 95-128.
Buchner, Multichannel Acoustic Echo Cancellation, http://www.buchner-net.com/mcaec.html, Jun. 2011.
Buck, Aspects of First-Order Differential Microphone Arrays in the Presence of Sensor Imperfections, Transactions on Emerging Telecommunications Technologies, vol. 13, No. 2, Mar.-Apr. 2002, pp. 115-122.
Buck, et al., Self-Calibrating Microphone Arrays for Speech Signal Acquisition: A Systematic Approach, Signal Processing, vol. 86, 2006, pp. 1230-1238.
Burton et al., A New Structure for Combining Echo Cancellation and Beamforming in Changing Acoustical Environments, IEEE International Conference on Acoustics, Speech and Signal Processing, 2007, pp. 1-77 -1-80.
Campbell, Adaptive Beamforming Using a Microphone Array for Hands-Free Telephony, Virginia Polytechnic Institute and State University, Feb. 1999,154 pgs.
Dhan et al., Uniform Concentric Circular Arrays with Frequency-Invariant Characteristics—Theory, Design, Adaptive Beamforming and DOA Estimation, IEEE Transactions on Signal Processing, vol. 55, No. 1, Jan. 2007, pp. 165-177.
Dhen et al., Design of Robust Broadband Beamformers with Passband Shaping Characteristics using Tikhonov Regularization, IEEE Transactions on Audio, Speech, and Language Processing, vol. 17, No. 4, May 2009, pp. 365-681.
Dhen, et al., A General Approach to the Design and Implementation of Linear Differential Microphone Arrays, Asia-Pacific Signal and Information Processing Association Annual Summit and Conference, 2013, 7 pgs.
Chou, "Frequency-Independent Beamformer with Low Response Error," 1995 International Conference on Acoustics, Speech, and Signal Processing, pp. 2995-2998, May 9, 1995,4 p.
Chou, Frequency-Independent Beamformer with Low Response Error, 1995 International Conference on Acoustics, Speech, and Signal Processing, May 1995, pp. 2995-2998.
Dhu, Desktop Mic Array for Teleconferencing, 1995 International Conference on Acoustics, Speech, and Signal Processing, May 1995, pp. 2999-3002.
ClearOne Communications, XAP Audio Conferencing White Paper, Aug. 2002, 78 pgs.
Clearone, Beamforming Microphone Array, Mar. 2012, 6 pgs.
Clearone, Ceiling Microphone Array Installation Manual, Jan. 9, 2012,20 pgs.
Dook, et al., An Alternative Approach to Interpolated Array Processing for Uniform Circular Arrays, Asia-Pacific Conference on Circuits and Systems, 2002, pp. 411-414.
Cox et al., Robust Adaptive Beamforming, IEEE Trans. Acoust., Speech, and Signal Processing, vol. ASSP-35, No. 10, Oct. 1987, pp. 1365-1376.
CTG Audio, Ceiling Microphone Ctg CM-01, Jun. 5, 2008, 2 pgs.
CTG Audio, CM-01 & CM-02 Ceiling Microphones Specifications, 2 pgs.
CTG Audio, CM-01 & CM-02 Ceiling Microphones, 2017, 4 pgs.
CTG Audio, Expand Your IP Teleconferencing to Full Room Audio, http://www.ctgaudio.com/expand-your-ip-teleconferencing-to-full-room-audio-while-conquering-echo-cancellation-issues.html, Jul. 29, 2014, 3 pgs.
CTG Audio, Installation Manual, Nov. 21, 2008, 25 pgs.
Ahonen, et al., "Directional Analysis of Sound Field with Linear Microphone Array and Applications in Sound Reproduction," Audio Engineering Socity, Convention Paper 7329, May 2008,11 pp.

(56) References Cited

OTHER PUBLICATIONS

ClearOne lnlioduces Ceiling Microphone Array With Built-In Dante Interface, Press Release; GlobeNewswire, Jan. 3, 2019,2 pp.
Giuliani, et al., "Use of Different Microphone Array Configuialions for Hands-Free Speech Recognition in Noisy and Reverberant Environment," IRST-lstituto per la Ricerca Scientifica e Tecnologica, Sep. 22, 1997,4 pp.
Microphone Array Primer, Shure Question and Answer Page, <https://service.shure.com/s/article/microphone-array-primer?language=en_US>, Jan. 2019, 5 pp.
Mohan, et al., "Localization of multiple acoustic sources with small arrays using a coherence test," Journal Acoustic Soc Am., 123(4), Apr. 2008, 12 pp.
Order, Conduct of the Proceeding, Clearone, Inc. v. Shure Acquisition Holdings, Inc., Nov. 2, 2020,10 pp.
Petitioner's Motion for Sanctions, Clearone, Inc. v. Shure Acquisition Holdings, Inc., Aug. 24, 2020, 20 pp.
"Vsa 2050 II Digitally Steerable col. Speaker," Web page https://www.rcf.it/en_us/products/product-detail/Vsa-2050-ii/972389, 15 pages, Dec. 24, 2018.
AVNetwork, "Top Five Conference Room Mic Myths," Feb. 25, 2015, 14 pp.
Benesty, et al., "Adaptive Algorithms for Mimo Acoustic Echo Cancellation," AI2 Allen Institute for Artifical Intelligence, 2003.
Benesty, et al., "Differential Beamforming," Fundamentals of Signal Enhancement and Array Signal Processing, First Edition, 2017, 39 pp.
Berkun, et al., "Combined Beamformers for Robust Broadband Regularized Superdirective Beamforming," IEEE/ACM Transactions on Audio, Speech, and Language Processing, vol. 23, No. 5, May 2015,10 pp.
Brooks, et al., "A Quantitative Assessment of Group Delay Methods for Identifying Glottal Closures in Voiced Speech," EEE Transaction on Audio, Speech, and Language Processing, vol. 14, No. 2, Mar. 2006,11 pp.
Buck, "Aspects of First-Order Differential Microphone Arrays in the Presence of Sensor Imperfections," Transactions on Emerging Telecommunications Technologies, 13.2,2002, 8 pp.
Buck, et al., "First Order Differential Microphone Arrays for Automotive Applications," 7th International Workshop on Acoustic Echo and Noise Control, Darmstadt University of Technology, Sep. 10-13, 2001,4 pp.
Cabral, et al., Glottal Spectral Separation for Speech Synthesis, IEEE Journal of Selected Topics in Signal Processing, 2013, 15 pp.
Cech, et al., "Active-Speaker Detection and Localization with Microphones and Cameras Embedded into a Robotic Head," IEEE-RAS International Conference on Humanoid Robots, Oct. 2013, pp. 203-210.
Chen, et al., "A General Approach to the Design and Implementation of Linear Differential Microphone Arrays," Signal and Information Processing Association Annual Summit and Conference, 2013 Asia-Pacific, IEEE, 7 pp.
Chen, et al., "Design and Implementation of Small Microphone Arrays," PowerPoint Presentation, Northwestern Polytechnical University and Institut national de la recherche scientifique, Jan. 1, 2014, 56 pp.
Clearone, Clearly Speaking Blog, "Advanced Beamforming Microphone Array Technology for Corporate Conferencing Systems," Nov. 11, 2013, 5 pp., http://www.clearone.com/blog/advanced-beamforming-microphone-array-technology-for-corporate-conferencing-systems/.
CTG Audio, Expand Your IP Teleconferencing to Full Room Audio, Obtained from website htt. ct audio com/ex and-, our-i -teleconforencino-to-ful-room-audio-while-conquennc.1-echo-cancelation-issues Mull, 2014.
Desiraju, et al., "Efficient Multi-Channel Acoustic Echo Cancellation Using ConsLiained Sparse Filter Updates in the Subband Domain," Acoustic Speech Enhancement Research, Sep. 2014.
Firoozabadi, et al., "Combination of Nested Microphone Array and Subband Processing for Multiple Simultaneous Speaker Localization," 6th International Symposium on Telecommunications, Nov. 2012, pp. 907-912.
Fohhn Audio New Generation of Beam Steering Systems Available Now, audioXpress Staff, May 10, 2017, 8 pp.
CONYX Gen5, Product Overview; Renkus-Heinz, Dec. 24, 2018,2 pp.
Nvensense, "Microphone Array Beamforming," Application Note AN-1140, Dec. 31, 2013,12 pp.
LecNet2 Sound System Design Guide, Lectrosonics, Jun. 2, 2006.
M. Kolundzija, C. Faller and M. Vetterii, "Baffled circular loudspeaker array with broadband high directivity," 2010 IEEE International Conference on Acoustics, Speech and Signal Processing, Dallas, TX, 2010, pp. 73-76.
Moulines, et al., "Pitch-Synchronous Waveform Processing Techniques for Text-to-Speech Synthesis Using Diphones," Speech Communication 9,1990,15 pp.
Multichannel Acoustic Echo Cancellation, Obtained from website http://www.buchner-net.com/mcaec.hlml, Jun. 2011.
Nguyen-Ky, et al., "An Improved Error Estimation Algorithm for Stereophonic Acoustic Echo Cancellation Systems," 1 s International Conference on Signal Processing and Communication Systems, Dec. 17-19, 2007.
Dlszewski, et al., "Steerable Highly Directional Audio Beam Loudspeaker," Interspeech 2005,4 pp.
Parikh, et al., "Methods for Mitigating IP Network Packet Loss in Real Time Audio Streaming Applications," GatesAir, 2014,6 pp.
Pasha, et al., "Clustered Multi-channel Dereverberation for Ad-hoc Microphone Arrays," Proceedings of APSIPA Annual Summit and Conference, Dec. 2015, pp. 274-278.
Phoenix Audio Technologies, "Beamforming and Microphone Arrays - Common Myths", Apr. 2016, http://i ifo. phnxaudio.com/blog/microphone-arrays-beamforming-myths-1, 19 pp.
Rane Acoustic Echo Cancellation Guide, AEC Guide Version 2, Nov. 2013.
Rao, et al., "Fast LMS/Newton Algorithms for Stereophonic Acoustic Echo Cancelation," IEEE Transactions on Signal Processing, vol. 57, No. 8, Aug. 2009.
Reuven, et al., "Multichannel Acoustic Echo Cancellation and Noise Reduction in Reverberant Environments Using the Transfer-Function Gsc," IEEE 1-4244-0728, 2007.
Serdes, Wikipedia article, last edited on Jun. 25, 2018; retrieved on Jun. 27, 2018, 3 pp., https://en.wikipedia.org/wiki SerDes.
Sessler, et al., "Directional Transducers," IEEE Transactions on Audio and Electroacoustics, vol. AU-19, No. 1, Mar. 1971, pp. 19-23.
Signal Processor MRX7-D Product Specifications, Yamaha Corporation, 2016.
Soundweb London Application Guides, BSS Audio, 2010.
SymNet Network Audio Solutions Brochure, Symetrix, Inc., 2008.
Tan, et al., "Pitch Detection Algorithm: Autocorrelation Method and AMDF," Department of Computer Engineering, Prince of Songkhla University, Jan. 2003, 6 pp.
Tandon, et al., "An Efficient, Low-Complexity, Normalized LMS Algorithm for Echo Cancellation," IEEE 0-7803-8322, Feb. 2004.
Weinstein, et al., "Loud: A 1020-Node Modular Microphone Array and Beamformer for Intelligent Computing Spaces," MIT Computer Science and Artifical Intelligence Laboratory, 2004,17 pp.
Wung, "A System Approach to Multi-Channel Acoustic Echo Cancellation and Residual Echo Suppression for Robust Hands-Free Teleconferencing," Georgia Institute of Technology, May 2015.
XAP Audio Conferencing Brochure, ClearOne Communications, Inc., 2002.
Tamaha Conference Echo Canceller PJP-EC200 Brochure, Yamaha Corporation, Oct. 2009.
Zavarehei, et al., "Interpolation of Lost Speech Segments Using LP-HNM Model with Codebook Post-Processing," EEE Transactions on Multimedia, vol. 10, No. 3, Apr. 2008,10 pp.
Zhang, et al., "Multichannel Acoustic Echo Cancelation in Multiparty Spatial Audio Conferencing with ConsLiained Kalman Filtering," 11 h International Workshop on Acoustic Echo and Noise Control, Sep. 14, 2008.

(56) References Cited

OTHER PUBLICATIONS

Zheng, et al., "Experimental Evaluation of a Nested Microphone Array With Adaptive Noise Cancellers," IEEE Transactions on Instrumentation and Measurement, vol. 53, No. 3, Jun. 2004,10 pp.
Chau, et al., "A Subband Beamfomner on an Ultra Low-Power Miniature DSP Platform," 2002 IEEE International Conference on Acoustics, Speech, and Signal Processing, 4 pp.
Fox, et al., "A Subband Hybrid Beamforming for In-Car Speech Enhancement," 20th European Signal recessing Conference, Aug. 2012, 5 pp.
Liu, et al., "Frequency Invariant Beamforming in Subbands," IEEE Conference on Signals, Systems and Computers, 2004, 5 pp.
Sallberg, "Faster Subband Signal Processing," IEEE Signal Processing Magazine, vol. 30, No. 5, Sep. 2013, 6 op.
Togami, et al., "Subband Beamfomner Combined with Time-Frequency ICA for Extraction of Target Source Under Reverberant Environments," 17th European Signal Processing Conference, Aug. 2009, 5 pp.
Yermeche, et al., "Real-Time DSP Implementation of a Subband Beamforming Algorithm for Dual Microphone Speech Enhancement," 2007 IEEE International Symposium on Circuits and Systems, 4 pp.
"Philips Hue Bulbs and Wireless Connected Lighting System," Web page https://www.philips-hue.com/en-in, 8 pp., Sep. 23, 2020, retrieved from Internet Archive Wayback Machine, <https://web.archive.org/web/20200923171037/https://www.philips-hue.com/en-in> on Sep. 27, 2021.
Alarifi, et al., "Ultra Wideband Indoor Positioning Technologies: Analysis and Recent Advances," Sensors 2016, vol. 16, No. 707, 36 pp.
Automixer Gated, Information Sheet, MIT, Nov. 2019, 9 pp.
Bn0055, Intelligent 9-axis absolute orientation sensor, Data sheet, Bosch, Nov. 2020,118 pp.
Clearone, Converge/Converge Pro, Manual, 2008, 51 pp.
Clearone, Professional Conferencing Microphones, Brochure, Mar. 2015, 3 pp.
Doleman, "Loudspeaker Array Processing for Personal Sound Zone Reproduction," Centre for Vision, Speech and Signal Processing, 2014, 239 pp.
Decawave, Application Note: APR001, Uwb Regulations, A Summary of Worldwide Telecommunications Regulations governing the use of Ultra-Wideband radio, Version 1.2,2015, 63 pp.
Dormehl, "HoloLens concept lets you control your smart home via augmented reality," digitaltrends, Jul. 26, 2016, 12 op.
Hayo, Virtual Controls for Real Life, Web page downloaded from https://hayo.io/ on Sep. 18, 2019, 19 pp.
Holm, "Optimizing Microphone Arrays for use in Conference Halls," Norwegian University of Science and Technology, Jun. 2009,101 pp.
International Search Report and Written Opinion for PCT/US2021/070625 dated Sep. 17, 2021, 17 pp.
International Search Report for PCT/US2020/024005 dated Jun. 12, 2020, 12 pp.
Mew Shure Microflex Advance MXA910 Microphone With Intellimix Audio Processing Provides Greater Simplicity, Flexibility, Clarity, Press Release, Jun. 12, 2019,4 pp.
Office Action for Taiwan Patent Application No. 105109900 dated May 5, 2017.
Palladino, "This App Lets You Control Your Smarthome Lights via Augmented Reality," Next Reality Mobile AR News, Jul. 2, 2018,5 pp.
Pfeifenberger, et al., "Nonlinear Residual Echo Suppression using a Recurrent Neural Network," Interspeech 2020, 5 op.
Polycom, Inc., Vortex EF2280 Reference Manual, 2001, 60 pp.
U.S. Appl. No. 16/598,918, filed Oct. 10, 2019, 50 pp.
Zhang, et al., "F-T-LSTM based Complex Network for Joint Acoustic Echo Cancellation and Speech Enhancement," Audio, Speech and Language Processing Group, Jun. 2021, 5 pp.
Amazon webpage for Metalfab MFLCRFG (last visited Apr. 22, 2020) available at <https://www.amazon.com/RETURN-FILTERGRILLE-Drop-Ceiling/dp/B0064Q9A7l/ref=sr 12? dchild=1&keywords=drop+ceiling+return+air+grille&qid=1585862723&s=hi&sr=1-2>, 11 pp.
Armstrong "Walls" Catalog available at <https://www.armstrongceilings.com/content/dam/armstrongceilings/commercial/north-america/catalogs/armstrong-ceilings-wallsspecifiers-reference.pdf>, 2019, 30 pp.
Armstrong Tectum Ceiling & Wall Panels Catalog available at <https://www.armstrongceilings.com/content/dam/armstrongceilings/commercial/north-america/brochures/tectum-brochure.pdf>, 2019, 16 pp.
Armstrong Woodworks Concealed Catalog available at <https://sweets.construction.com/swts_content_files/3824/442581.pdf>, 2014, 6 pp.
Armstrong Woodworks Walls Catalog available at <https://www.armstrongceilings.com/pdbupimagesclg/220600.pdf/download/data-sheet-woodworks-walls.pdf>, 2019, 2 pp.
Armstrong, Acoustical Design: Exposed Structure, available at <https://www.armstrongceilings.com/pdbupimagesclg/217142.pdf/download/acoustical-design-exposed-structurespaces-brochure.pdf>, 2018, 19 pp.
Armstrong, Ceiling Systems, Brochure page for Armstrong Softlook, 1995, 2 pp.
Armstrong, Excerpts from Armstrong 2011-2012 Ceiling Wall Systems Catalog, available at <https://web.archive.org/web/20121116034120/http://www.armst rong.com/commceilingsna/en_us/pdf/ceilings_catalog_screen-2011 .pdf>, as early as 2012, 162 pp.
Armstrong, i-Ceilings, Brochure, 2009, 12 pp.
Benesty, et al., "Microphone Array Signal Processing," Springer, 2010, 20 pp.
BZ-3a Installation Instructions, XEDIT Corporation, Available at <chrome-extension://efaidnbmnnnibpcajpcgiclefindmkaj/viewer.html?pdfurl=https%3A%2F%2Fwww.servo reelers, com %2Fmt-content%2Fuploads%2F2017%2F05%2Fbz-a-3universal-2017c.pdf&clen=189067&chunk=true>, 1 p.
Cao, "Survey on Acoustic Vector Sensor and its Applications in Signal Processing" Proceedings of the 33rd Chinese Control Conference, Jul. 2014, 17 pp.
Circuit Specialists webpage for an aluminum enclosure, available at <https://www.circuitspecialists.com/metal-instrument-enclosure-la7.html? otaid=gpl&gclid=EAIalQobChMI2JTw-Ynm6AIVgbblCh3F4QKuEAkYBiABEgJZMPD_BwE>, 3 pp.
ClearOne Launches Second Generation of its Groundbreaking Beamforming Microphone Array, Press Release, Acquire Media, Jun. 1, 2016, 2 pp.
ClearOne to Unveil Beamforming Microphone Array with Adaptive Steering and Next Generation Acoustic Echo Cancellation Technology, Press Release, InfoComm, Jun. 4, 2012, 1 p.
CTG Audio, Ctg FS-400 and RS-800 with "Beamforming" Technology, Datasheet, As early as 2009, 2 pp.
CTG Audio, CTG User Manual for the FS- 400/800 Beamforming Mixers, Nov. 2008, 26 pp.
CTG Audio, Frequently Asked Questions, As early as 2009, 2 pp.
CTG Audio, Installation Manual and User Guidelines for the Soundman SM 02 System, May 2001, 29 pp.
CTG Audio, Introducing the Ctg FS-400 and FS-800 with Beamforming Technology, As early as 2008, 2 pp.
CTG Audio, Meeting the Demand for Ceiling Mies in the Enterprise 5 Best Practices, Brochure, 2012, 9 pp.
Diethorn, "Audio Signal Processing For Next-Generation Multimedia Communication Systems," Chapter 4, 2004, 9 pp.
Digikey webpage for Converta box (last visited Apr. 22, 2020) <https://www.digikey.com/product-detail/en/bud-industries/CU-452-A/377-1969-ND/439257? utm_adgroup=Boxes&utm_source=google&utm_medium=cpc&utm_campaign=Shopping_Boxes %2C%20Enclosures%2C%20Racks NEW&utm term=&utm content=Boxes&gclid=EAIaIQobC hMI2JTw-Ynm6AIVgbblCh3F4QKuEAkYCSABEgKybPD_BwE>, 3 pp.
Digikey webpage for Pomona Box (last visited Apr. 22, 2020) available at <https://www.digikey.com/product-detail/en/pomonaelectronics/3306/501 -2054-ND/736489>, 2 pp.

(56) References Cited

OTHER PUBLICATIONS

Digital Wireless Conference System, MCW-D 50, Beyerdynamic Inc., 2009, 18 pp.
Dominguez, et al., "Towards an Environmental Measurement Cloud: Delivering Pollution Awareness to the Public," International Journal of Distributed Sensor Networks, vol. 10, Issue 3, Mar. 31, 2014, 17 pp.
Double Condenser Microphone SM 69, Datasheet, Georg Neumann GmbH, available at <https://ende.neumann.com/product_files/7453/download>, 8 pp.
Eargle, "The Microphone Handbook," Elar Publ. Co., 1st ed., 1981,4 pp.
Enright, Notes From Logan, June edition of Scanlines, Jun. 2009, 9 pp.
Hald, et al., "A class of optimal broadband phased array geometries designed for easy construction," 2002 Int'l Congress & Expo, on Noise Control Engineering, Aug. 2002, 6 pp.
Invensense, Recommendations for Mounting and Connecting InvenSense MEMS Microphones, Application Note AN-1003, 2013, 11 pp.
Johnson, et al., "Array Signal Processing: Concepts and Techniques," p. 59, Prentice Hall, 1993, 3 p.
Klegon, "Achieve Invisible Audio with the MXA910 Ceiling Array Microphone," Jun. 27, 2016, 10 pp.
Lai, et al., "Design of Robust Steerable Broadband Beamformers with Spiral Arrays and the Farrow Filter Structure," Proc. Inti. Workshop Acoustic Echo Noise Control, 2010, 4 pp.
Li, "Broadband Beamforming and Direction Finding Using Concentric Ring Array," Ph.D. Dissertation, University of Missouri-Columbia, Jul. 2005, 163 pp.
Liu, et al., "Wideband Beamforming," Wiley Series on Wireless Communications and Mobile Computing, pp. 143-198, 2010, 297 p.
MFLCRFG Datasheet, Metal_Fab Inc., Sep. 7, 2007, 1 p.
Milanovic, et al., "Design and Realization of FPGA Platform for Real Time Acoustic Signal Acquisition and Data Processing" 22nd Telecommunications Forum TELFOR, 2014, 6 pp.
Pomona, Model 3306, Datasheet, Jun. 9, 1999, 1 p.
Prime, et al., "Beamforming Array Optimisation Averaged Sound Source Mapping on a Model Wind Turbine," ResearchGate, Nov. 2014, 10 pp.
Sessler, et al., "Toroidal Microphones," Journal of Acoustical Society of America, vol. 46, No. 1, 1969, 10 pp.
Shure Debuts Microflex Advance Ceiling and Table Array Microphones, Press Release, Feb. 9, 2016,4 pp.
Shure Inc., A910-HCM Hard Ceiling Mount, retrieved from website <http://www.shure.com/en-US/products/accessories/a910hcm> on Jan. 16, 2020, 3 pp.
Shure, MXA910 With IntelliMix, Ceiling Array Microphone, available at <https://www.shure.com/en-US/products/microphones/mxa910>, as early as 2020,12 pp.
Shure, New MXA910 Variant Now Available, Press Release, Dec. 13, 2019, 5 pp.
Shure, Q&A in Response to Recent US Court Ruling on Shure MXA910, Available at chttps://www.shure.com/en-US/meta/legal/q-and-a-inresponse-to-recent-US-court-ruling-on-shure-mxa910-response>, As early as 2020, 5 pp.
Shure, RK244G Replacement Screen and Grille, Datasheet, 2013, 1 p.
Shure, The Microflex Advance MXA310 Table Array Microphone, Available at chttps://www.shure.com/en-US/products/microphones/mxa310>, As early as 2020, 12 pp.
SM 69 Stereo Microphone, Datasheet, Georg Neumann GmbH, Available at chttps://ende.neumann.com/product_files/6552/download>, 1 p.
Vicente, "Adaptive Array Signal Processing Using the Concentric Ring Array and the Spherical Array," Ph.D. Dissertation, University of Missouri, May 2009, 226 pp.
Warsitz, et al., "Blind Acoustic Beamforming Based on Generalized Eigenvalue Decomposition," IEEE Transactions on Audio, Speech and Language Processing, vol. 15, No. 5, 2007, 11 pp.
Canetto, et al., "Speech Enhancement Systems Based on Microphone Arrays," VI Conference of the Italian Society for Applied and Industrial Mathematics, May 27, 2002, 9 pp.
International Search Report and Written Opinion for PCT/US2020/058385 dated Mar. 31, 2021,20 pp.

* cited by examiner

PATTERN-FORMING MICROPHONE ARRAY

CROSS-REFERENCE TO RELATED APPLICATIONS

This application claims priority from U.S. Provisional Application Ser. No. 62/679,452, filed on Jun. 1, 2018, the content of which is incorporated herein by reference in its entirety.

TECHNICAL FIELD

This application generally relates to microphone arrays. In particular, this application relates to a microphone array configurable to form one or more desired polar patterns.

BACKGROUND

In general, microphones are available in a variety of sizes, form factors, mounting options, and wiring options to suit the needs of a given application. There are several different types of microphones and related transducers, such as, for example, dynamic, crystal, condenser/capacitor (externally biased and electret), Micro-Electrical-Mechanical-System ("MEMS"), etc., each having its advantages and disadvantages depending on the application. The different microphones can be designed to produce different polar response patterns, including, for example, omnidirectional, cardioid, subcardioid, supercardioid, hypercardioid, and bidirectional. The polar pattern chosen for a particular microphone (or microphone cartridge included therein) may depend on, for example, where the audio source is located, the desire to exclude unwanted noises, and/or other considerations.

In conferencing environments, such as boardrooms, video conferencing settings, and the like, one or more microphones are used to capture sound from multiple audio sources. The audio sources may include in-room human speakers, and in some cases, loudspeakers for playing audio received from human speakers that are not in the room, for example. The captured sound may be disseminated to an audience through loudspeakers in the environment, a telecast, a webcast, telephony, etc. The types of microphones and their placement in a particular conferencing environment may depend on the locations of the audio sources, the loudspeakers, physical space requirements, aesthetics, room layout, and/or other considerations. For example, in some environments, the microphones may be placed on a table or lectern near the audio sources. In other environments, the microphones may be mounted overhead to capture the sound from the entire room, for example.

Some existing conferencing systems employ boundary microphones and button microphones that can be positioned on or in a surface (e.g., a table). Such microphones typically include multiple cartridges so that the microphones can have multiple independent polar patterns to capture sound from multiple audio sources (e.g., human speakers seated at different sides of a table). Other such microphones may include multiple cartridges so that various polar patterns can be formed by appropriately processing the audio signals from each cartridge, thus eliminating the need to physically swap cartridges to obtain a different polar pattern. For these types of microphones, while it would be ideal to co-locate the multiple cartridges within the microphone, so that each cartridge detects sounds in the environment at the same instant, it is not, however, physically possible to do so. As such, these types of microphones may not uniformly form the desired polar patterns and may not ideally capture sound due to frequency response irregularities, as well as interference and reflections within and between the cartridges.

In most conferencing environments, it is desirable for a microphone to have a toroidal polar pattern that is omnidirectional in the plane of the microphone with a null in the axis perpendicular to that plane. For example, a toroidal microphone that is positioned on a conference table may be configured to detect sound in all directions along the plane of the table, but minimize the detection of sound above the microphone, e.g., in the direction pointing towards the ceiling and/or away from the table. However, existing microphones with toroidal polar patterns may be physically large, have a high self-noise, require complex processing, and/or have inconsistent polar patterns over a full frequency range, e.g., 100 Hz to 10 kHz.

Micro-Electrical-Mechanical-System ("MEMS") microphones, or microphones that have a MEMS element as the core transducer, have become increasingly popular due to their small package size (e.g., allowing for an overall lower profile device) and high performance characteristics (e.g., high signal-to-noise ratio ("SNR"), low power consumption, good sensitivity, etc.). In addition, MEMS microphones are generally easier to assemble and available at a lower cost than, for example, electret or condenser microphone cartridges found in many existing boundary microphones. However, due to the physical constraints of the MEMS microphone packaging, the polar pattern of a conventional MEMS microphone is inherently omnidirectional, which means the microphone is equally sensitive to sounds coming from any and all directions, regardless of the microphone's orientation. This can be less than ideal for conferencing environments, in particular.

One existing solution for obtaining directionality using MEMS microphones includes placing multiple microphones in an array configuration and applying appropriate beamforming techniques (e.g., signal processing) to produce a desired directional response, or a beam pattern that is more sensitive to sound coming from one or more specific directions than sound coming from other directions. Such microphone arrays may have different configurations and frequency responses depending on the placement of the microphones relative to each other and the direction of arrival for sound waves. For example, a broadside microphone array includes a line of microphones arranged perpendicular to the preferred direction of sound arrival. The output for such arrays is obtained by simply summing the resulting microphone signals together, thus producing a flat and on-axis response.

As another example, an endfire array includes multiple microphones arranged in-line with the desired direction of sound propagation. In a differential endfire array, the signal captured by the front microphone in the array (i.e. the first microphone reached by sound propagating on-axis) is summed with an inverted and delayed version of the signal captured by the rear microphone in the array (i.e. positioned opposite the front microphone) to produce cardioid, hypercardioid, or supercardioid pickup patterns, for example. In such cases, the sound from the rear of the array is greatly or completely attenuated, while the sound from the front of the array has little or no attenuation. The frequency response of a differential endfire array is not flat, so an equalization filter is typically applied to the output of the differential beamforming algorithm to flatten the response. While MEMS microphone endfire arrays are currently in use, specifically in the handset and hearing health industries, the existing products do not provide the high performance characteristics required for conferencing platforms (e.g., maximum signal-to-noise ratio (SNR), planar directional pickup, wideband audio coverage, etc.).

Accordingly, there is still a need for a low profile, high performing microphone array capable of forming one or more directional polar patterns that can be isolated from unwanted ambient sounds, so as to provide full, natural-sounding speech pickup suitable for conferencing applications.

SUMMARY

The invention is intended to solve the above-noted and other problems by providing a microphone array that is designed to, among other things, provide (1) at least one linear microphone array comprising one or more sets of microphone elements nested within one or more other sets, each set including at least two microphones separated by a distance selected to cover a desired operating band; (2) a beamformer configured to generate a combined output signal for the linear array having a desired directional polar pattern (e.g., toroidal, cardioid, etc.); and (3) high performance characteristics suitable for conferencing environments, such as, e.g., a highly directional polar pattern, high signal-to-noise ratio (SNR), wideband audio coverage, etc.

For example, one embodiment includes a microphone array with a plurality of microphone elements comprising: a first set of elements arranged along a first axis and comprising at least two microphone elements spaced apart from each other by a first distance, and a second set of elements arranged along the first axis and comprising at least two microphone elements spaced apart from each other by a second distance greater than the first distance, such that the first set is nested within the second set, wherein the first distance is selected for optimal microphone operation in a first frequency band, and the second distance is selected for optimal microphone operation in a second frequency band that is lower than the first frequency band.

Another example embodiment includes a method of assembling a microphone array, the method comprising: forming a first set of microphone elements along a first axis, the first set including at least two microphone elements spaced apart from each other by a first distance; forming a second set of microphone elements along the first axis, the second set including at least two microphone elements spaced apart from each other by a second distance greater than the first distance, such that the first set is nested within the second set; and electrically coupling each microphone element to at least one processor for processing audio signals captured by the microphone elements, wherein the first distance is selected for optimal microphone operation in a first frequency band, and the second distance is selected for optimal microphone operation in a second frequency band that is lower than the first frequency band.

Exemplary embodiments also include a microphone system comprising: a microphone array including a plurality of microphone elements coupled to a support, the plurality of microphone elements comprising first and second sets of elements arranged along a first axis of the support, the first set being nested within the second set, wherein the first set includes at least two microphone elements spaced apart from each other by a first distance selected to configure the first set for optimal microphone operation in a first frequency band, and the second set includes at least two microphone elements spaced apart from each other by a second distance that is greater than the first distance, the second distance being selected to configure the second set for optimal microphone operation in a second frequency band that is lower than the first frequency band; a memory configured to store program code for processing audio signals captured by the plurality of microphone elements and generating an output signal based thereon; and at least one processor in communication with the memory and the microphone array, the at least one processor configured to execute the program code in response to receiving audio signals from the microphone array, wherein the program code is configured to: receive audio signals from each microphone element of the microphone array; for each set of elements along the first axis, combine the audio signals for the microphones in the set to generate a combined output signal with a directional polar pattern; and combine the combined output signals for the first and second sets to generate a final output signal for all of the microphone elements on the first axis.

Yet another exemplary embodiment includes a method performed by one or more processors to generate an output signal for a microphone array comprising a plurality of microphone elements coupled to a support. The method comprises: receiving audio signals from the plurality of microphone elements, the plurality of microphone elements comprising first and second sets of elements arranged along a first axis of the support, the first set being nested within the second set, wherein the first set includes at least two microphone elements spaced apart from each other by a first distance selected to configure the first set for optimal microphone operation in a first frequency band, and the second set includes at least two microphone elements spaced apart from each other by a second distance that is greater than the first distance, the second distance being selected to configure the second set for optimal microphone operation in a second frequency band that is lower than the first frequency band; for each set of elements along the first axis, combining the audio signals for the microphone elements in the set to generate a combined output signal with a directional polar pattern; and combining the combined output signals for the first and second sets to generate a final output signal for all microphone elements on the first axis.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
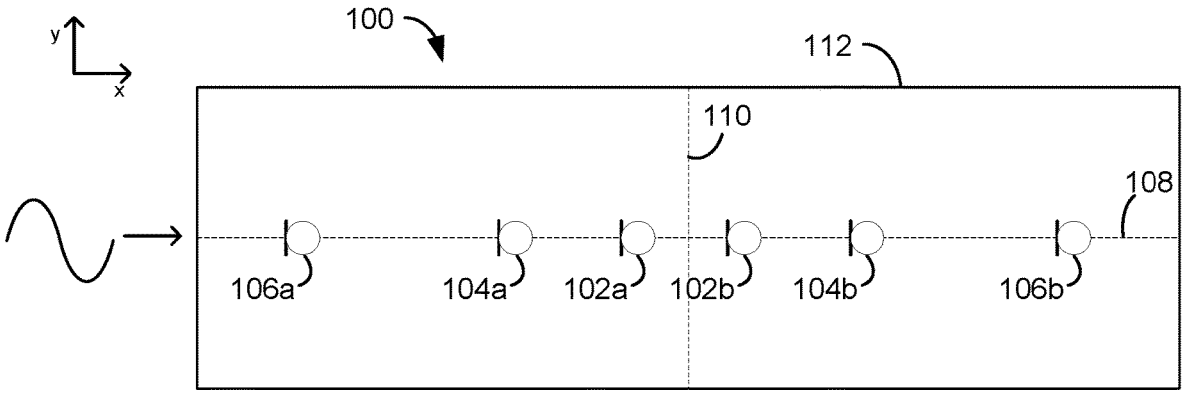
FIG. 1 is a schematic diagram illustrating an exemplary microphone array in accordance with one or more embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

Systems and methods are provided herein for a high performing microphone comprising at least one linear array with multiple pairs (or sets) of microphone elements spaced apart by specified distances and arranged in a nested configuration to achieve coverage of desired operating bands, a high signal-to-noise ratio (SNR), and a directional polar pattern. Exemplary embodiments also include a microphone with at least two orthogonal linear arrays having a shared center and symmetrical placement of microphone elements on each axis to create a planar directional pickup pattern. Embodiments further include linear arrays in which at least one of the microphone pairs (or sets) comprise spaced apart clusters of two or more microphone elements to create a higher sensitivity microphone with an improved SNR. In preferred embodiments, the microphone elements are MEMS transducers or other omnidirectional microphones. These and other array forming features are described in more detail herein, particularly with respect to FIGS. 1 to 4.

Embodiments also include one or more beamformers for combining the polar patterns for each set of microphone elements on a given axis and then summing the combined outputs for the various sets to obtain a final output with a directional polar pattern (such as, e.g., cardioid, etc.). In the case of orthogonal linear arrays, the beamformers can combine the final outputs for each axis to achieve planar directional pickup (such as, e.g., toroidal, etc.). In some embodiments, the one or more beamformers use crossover filtering to isolate each set of microphone elements to its optimal frequency band (or range) and then sum or stitch together the outputs of each set to obtain a desired frequency response that covers all or most of the audible bandwidth (e.g., 20 Hz to 20 kHz) and has a higher SNR than, for example, that of the individual microphone elements. These and other beamforming techniques are described in more detail herein, particularly with respect to FIGS. 5 to 8.

FIG. 1 illustrates an exemplary microphone 100 comprising a microphone array that can detect sounds from one or more audio sources at various frequencies, in accordance with embodiments. The microphone 100 may be utilized in a conferencing environment, such as, for example, a conference room, a boardroom, or other meeting room where the audio source includes one or more human speakers. Other sounds may be present in the environment which may be undesirable, such as noise from ventilation, other persons, audio/visual equipment, electronic devices, etc. In a typical situation, the audio sources may be seated in chairs at a table, although other configurations and placements of the audio sources are contemplated and possible, including, for example, audio sources that move about the room. The microphone 100 can be placed on a table, lectern, desktop, etc. in order to detect and capture sound from the audio sources, such as speech spoken by human speakers.

The microphone array of microphone 100 is comprised of multiple microphone elements 102*a,b*, 104*a,b*, 106*a,b* that can form multiple pickup patterns for optimally detecting and capturing the sound from said audio sources. In FIG. 1, the microphone elements 102*a,b*, 104*a,b*, 106*a,b* are generally arranged in a linear fashion along a length of the microphone 100. In embodiments, the microphone elements 102*a,b*, 104*a,b*, 106*a,b* may be disposed along a common axis of the microphone 100, such as, e.g., a first axis 108. In the illustrated embodiment, the first axis 108 coincides with an x-axis of the microphone 100, which passes through, or intersects with, a y-axis (e.g., second axis 110) of the microphone 100 at a common central point (or midpoint). In other cases, the first axis 108 may be parallel to the x-axis and vertically offset from the central point of the microphone 100 (e.g., above or below the center). In still other cases, the first axis 108 may be angled relative to both the x-axis and the y-axis so as to form a diagonal line there between (see, e.g., FIG. 3). In some cases, the microphone array includes microphone elements arranged along a y-axis (e.g., second axis 110) of the microphone 100 (not shown), instead of the first axis 108.

Figure 3:
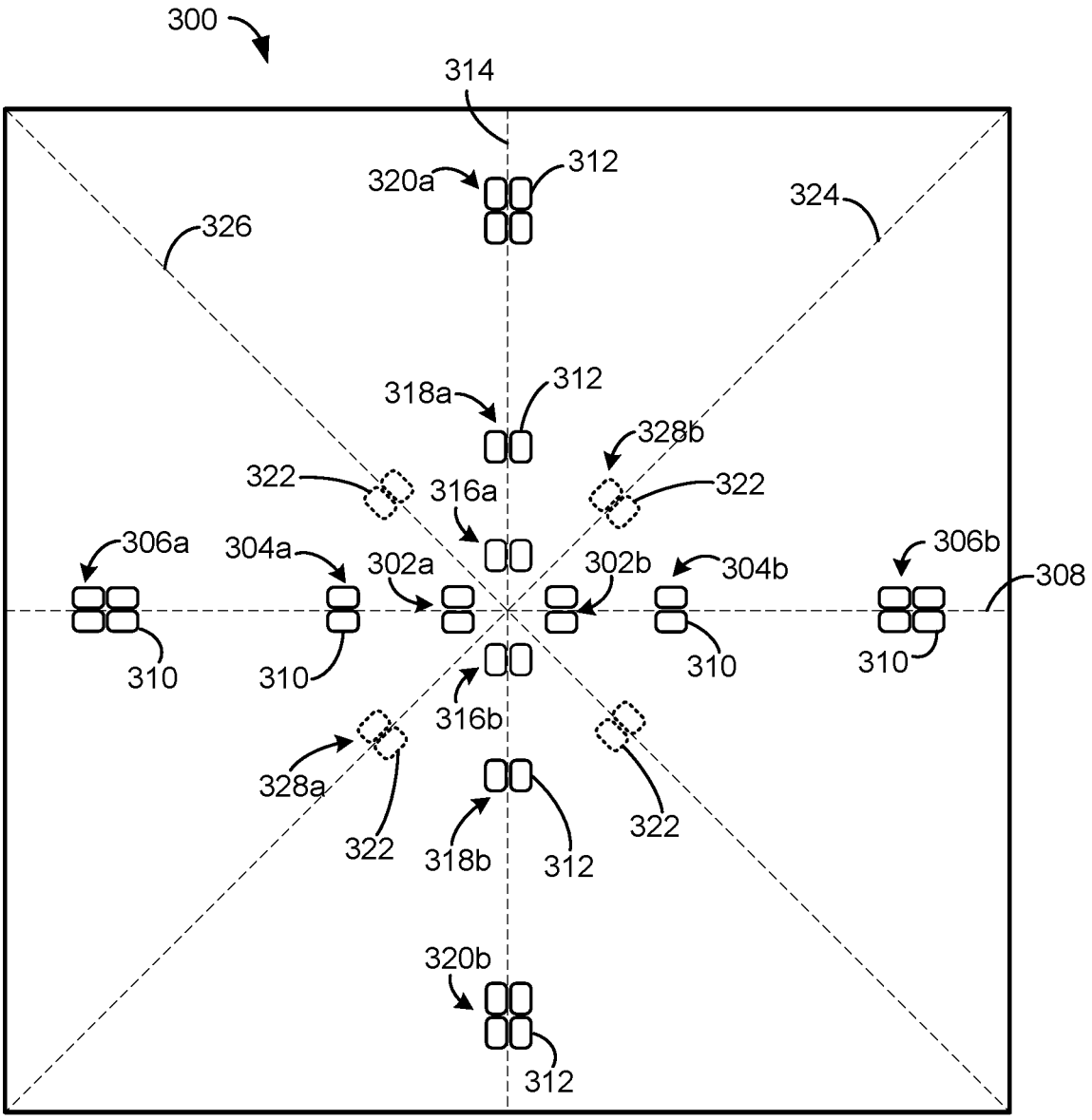
FIG. 3 is a schematic diagram illustrating another exemplary microphone array in accordance with one or more embodiments.
Figure 4:
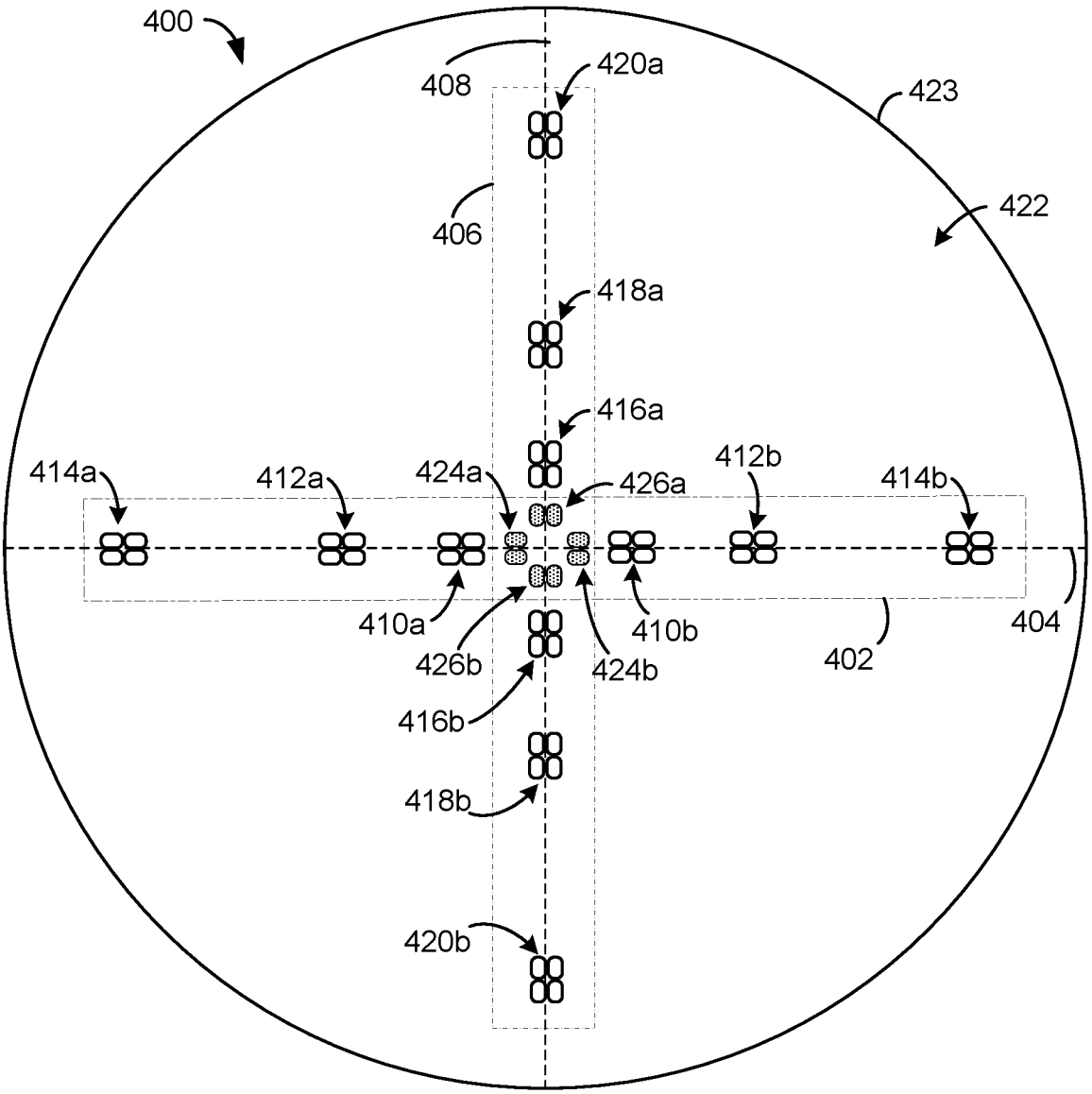
FIG. 4 is a schematic diagram illustrating still another exemplary microphone array in accordance with one or more embodiments.

Although FIG. 1 shows six microphone elements 102*a,b*, 104*a,b*, 106*a,b*, other numbers (e.g., larger or fewer) of microphone elements are possible and contemplated, for example, as shown in FIGS. 3 and 4. The polar patterns that can be formed by the microphone 100 may include omnidirectional, cardioid, subcardioid, supercardioid, hypercardioid, bidirectional, and/or toroidal. In some embodiments, each of the microphone elements 102*a,b*, 104*a,b*, 106*a,b* of the microphone 100 may be a MEMS (micro-electrical mechanical system) transducer with an inherent omnidirectional polar pattern. In other embodiments, the microphone elements 102*a,b*, 104*a,b*, 106*a,b* may have other polar patterns, may be any other type of omnidirectional microphone, and/or may be condenser microphones, dynamic microphones, piezoelectric microphones, etc. In still other embodiments, the arrangement and/or processing techniques described herein can be applied to other types of arrays comprised of omnidirectional transducers or sensors where directionality is desired (such as, e.g., sonar arrays, radio frequency applications, seismic devices, etc.).

Each of the microphone elements 102*a,b*, 104*a,b*, 106*a,b* in the microphone 100 can detect sound and convert the sound into an audio signal. In some cases, the audio signal can be a digital audio output. For other types of microphone elements, the audio signal may be an analog audio output, and components of the microphone 100, such as analog to digital converters, processors, and/or other components, may process the analog audio signals to ultimately generate one or more digital audio output signals. The digital audio output signals may conform to the Dante standard for transmitting audio over Ethernet, in some embodiments, or may conform to another standard. In certain embodiments, one or more pickup patterns may be formed by the processor of the microphone 100 from the audio signals of the microphone elements 102*a,b*, 104*a,b*, 106*a,b*, and the processor may generate a digital audio output signal corresponding to each of the pickup patterns. In other embodiments, the microphone elements 102*a,b*, 104*a,b*, 106*a,b* of the microphone 100 may output analog audio signals and other components and devices (e.g., processors, mixers, recorders, amplifiers, etc.) external to the microphone 100 may process the analog audio signals.

The microphone 100 may further include a support 112 (such as, e.g., a substrate, printed circuit board, frame, etc.) for supporting the microphone elements 102*a,b*, 104*a,b*, 106*a,b*. The support 112 may have any size or shape including, for example, a rectangle (e.g., FIG. 1), square (e.g., FIG. 3), circle (e.g., FIG. 4), hexagon, etc. In some cases, the support 112 may be sized and shaped to meet the constraints of a pre-existing device housing and/or to achieve desired performance characteristics (e.g., select operating bands, high SNR, etc.). For example, a maximum width and/or length of the microphone array may be determined by the overall width of a device housing.

In embodiments, each of the microphone elements 102*a,b*, 104*a,b*, 106*a,b* is mechanically and/or electrically coupled to the support 112. For example, in the case of a PCB, the microphone elements 102*a,b*, 104*a,b*, 106*a,b* may be electrically coupled to the support 112, and the PCB/support 112 may be electrically coupled to one or more processors or other electronic device for receiving and processing audio signals captured by the microphone elements 102*a,b*, 104*a,b*, 106*a,b*. In some embodiments, the microphone elements 102*a,b*, 104*a,b*, 106*a,b* are embedded into or physically located on the support 112. In other embodiments, the microphone elements 102*a,b*, 104*a,b*, 106*a,b* may be suspended from (e.g., dangling below) the support 112 using, for example, a plurality of wires respectively coupled between the microphone elements 102*a,b*, 104*a,b*, 106*a,b* and the support 112. In still other embodiments, each of the microphone elements 102*a,b*, 104*a,b*, 106*a,b* of the microphone 100 may not be physically connected to each other or a specific support, but may be wirelessly connected to a processor or audio receiver so as to form a distributed network of microphones. In such cases, the microphone elements 102*a,b*, 104*a,b*, 106*a,b* may be individually arranged on, or suspended from, one or more surfaces within the conferencing environment or table, for example.

In FIG. 1, the microphone elements 102*a,b*, 104*a,b*, 106*a,b* are arranged in the same plane and on the same surface or side of the support 112 (e.g., a front or top surface). In other embodiments, the microphone 100 also includes one or more microphones (not shown) arranged on an opposite side or surface (e.g., back or bottom surface) of the support 112 (see, e.g., FIG. 4), so as to increase the total number of microphone elements included in the microphone array and/or to enable the microphone 100 to cover more frequency bands.

In some embodiments, the microphone 100 comprises additional microphone elements (not shown) arranged along one or more other axes of the microphone 100 (see, e.g., FIG. 3). In such cases, the other axes, like the second axis 110, for example, may intersect with the first axis 108 at the center or midpoint of the microphone 100 and may be co-located in the same plane as the first axis 108 (see, e.g., FIGS. 3 and 4). The placement of additional microphone elements on such other axes having a shared center can, among other things, enable or enhance the ability to achieve planar directionality for the output of the microphone 100, as described herein.

Figure 2:
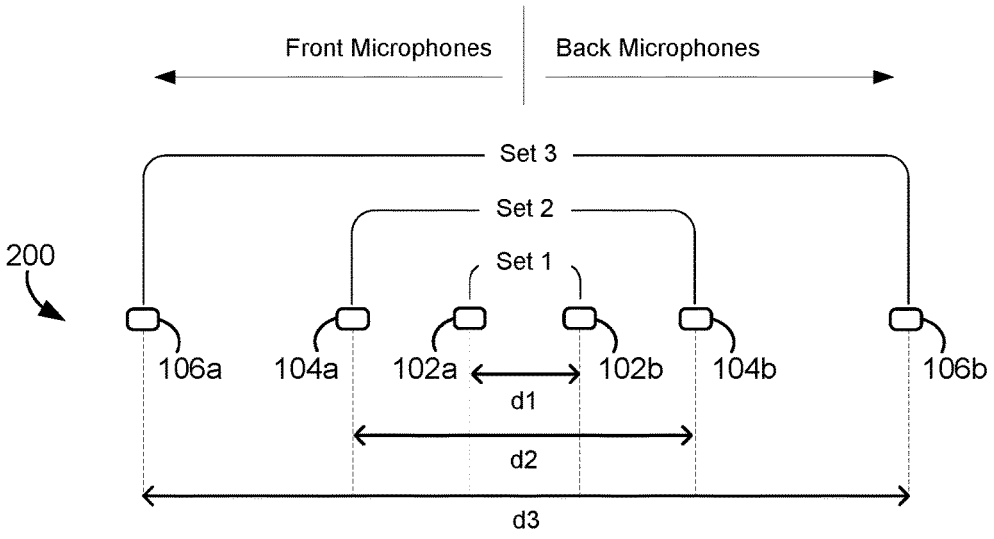
FIG. 2 is a schematic diagram illustrating design considerations for the microphone array of FIG. 1 in accordance with one or more embodiments.

According to embodiments, the microphone elements 102*a,b*, 104*a,b*, 106*a,b* of the microphone 100 can be arranged in a nested configuration made up of various sets or groups of microphone elements. This configuration is further illustrated in FIG. 2, which depicts a microphone array 200 comprised of the microphone elements 102*a,b*, 104*a,b*, 106*a,b* shown in FIG. 1. As shown in FIG. 2, a first set 102 ("Set 1") includes the microphone elements 102*a* and 102*b* spaced apart from each other by a first distance d1 that is the smallest or nearest distance of the three sets; a second set 104 ("Set 2") includes the microphone elements 104*a* and 104*b* spaced apart from each other by a second distance d2 that is greater than the first distance, or the middle or intermediate distance of the three sets; and a third set 106 ("Set 3") includes the microphone elements 106*a* and 106*b* spaced apart from each other by a third distance d3 that is greater than the second distance, or the largest or furthest distance of the three sets. The nested configuration can be achieved by placing the microphone elements 106*a,b* of Set 3 at the outer ends of the microphone array 200, placing or nesting the microphone elements 104*a,b* of Set 2 within the microphone elements 106*a,b* of Set 3, and placing or nesting the microphone elements 102*a,b* of Set 1 within the microphone elements 104*a,b* of Set 2. While three nested groups are shown in FIGS. 1 and 2, other numbers of nested groups (and microphone elements) are possible and contemplated (e.g., as shown in FIGS. 3 and 4). For example, the exact number of nested groups may depend on the desired number of operating bands for the microphone array 200 and/or the physical constraints of a device housing.

According to embodiments, the distance between the respective microphone elements within a given set 102, 104, or 106 can be selected to optimally cover a desired frequency band or range (also referred to herein as "operating band"). In particular, Set 1 (including microphone elements 102*a,b*) may be configured to cover a first or higher frequency band, Set 2 (including microphone elements 104*a,b*) may be configured to cover a second or middle frequency band (or range), and Set 3 (including microphone elements 106*a,b*) may be configured to cover a third or lower frequency band (or range). In some cases, the spacing between the elements in the middle Set 2, and therefore, the frequency band coverage provided thereby, may be selected to bridge the gap between the high frequency band covered by Set 1 and the low frequency band covered by Set 3 and/or to keep a noise level of the microphone array output low. In embodiments, appropriate beamforming techniques may be utilized to combine the outputs of the different sets 1, 2, and 3, so that the overall microphone 100 achieves a desired frequency response, including, for example, lower noise characteristics, higher microphone sensitivity, and coverage of discrete frequency bands, as described in more detail herein.

In the illustrated embodiment, each of the nested groups 102, 104, 106 includes at least one front microphone element 102*a*, 104*a*, or 106*a* and at least one back microphone element 102*b*, 104*b*, or 106*b*, respectively, arranged in a linear endfire array. That is, the microphone elements in each set are arranged in-line with the direction of on-axis sound propagation, such that sound reaches the front microphone elements 102*a*, 104*a*, or 106*a* before reaching the corresponding back microphone elements 102*b*, 104*b*, or 106*b*. Due to this linear configuration, the sound picked up by the different microphone elements in each of the Sets 1, 2, and 3 may differ only in terms of arrival time. In embodiments, appropriate beamforming techniques may be applied to the microphone elements 102*a,b*, 104*a,b*, 106*a,b* so that each of the nested Sets 1, 2, 3 effectively operates as independent microphone arrays having a desired directional pickup pattern and frequency response characteristics, as described in more detail herein (see, e.g., FIGS. 5-7). In some embodiments, the "front" and "back" designations may be programmatically assigned by the processor depending on the design considerations for the microphone 100. In one example embodiment, the processor can flip the "front" orientation of the elements 102*a*, 104*a*, 106*a* to "back" and the "back" orientation of the elements 102*b*, 104*b*, 106*b* to "front," and represent both configurations simultaneously, thus creating two cardioids on two output channels, one having an on-axis orientation that is 180 degrees rotated from the other.

In FIGS. 1 and 2, each of the nested groups 102, 104, 106 includes exactly two microphone elements. In other embodiments, for example, as shown in FIGS. 3 and 4, at least one of the nested groups includes two clusters of microphone spaced apart by the specified distance (e.g., d1, d2, or d3), instead of the individual microphone elements shown in FIGS. 1 and 2. In such cases, each cluster includes two or more microphone elements positioned adjacent, or in very close proximity, to each other. In embodiments, appropriate beamforming techniques may be used to sum together the audio signals captured by the microphone elements within each cluster, so that the cluster effectively operates as a single, higher sensitivity microphone with boosted SNR characteristics, as described in more detail herein.

Referring now to FIG. 3, shown is an exemplary microphone 300 comprising a plurality of microphone clusters 302*a,b*, 304*a,b*, 306*a,b* arranged in nested pairs 302, 304, 306, respectively, along a first axis 308 (e.g., x-axis) of the microphone 300, in accordance with embodiments. Each of the clusters 302*a,b*, 304*a,b*, 306*a,b* includes a plurality of microphone elements 310 arranged in close proximity to each other. The microphone elements 310 within each of the clusters 302*a,b*, 304*a,b*, 306*a,b* may also be arranged symmetrically about the first axis 308, as shown. The microphone elements 310 can be electrically and/or mechanically coupled to a support 311 (e.g., a frame, a PCB, a substrate, etc.) that generally defines an overall size and shape (shown here as a square) of the microphone 300. In embodiments, the microphone elements 310 can be MEMS transducers, other types of omnidirectional microphones, dynamic or condenser microphones, other types of omnidirectional transducers, etc.

While FIG. 3 shows clusters of two or four microphone elements, other numbers (including, e.g., odd numbers) of microphones elements for a given cluster are possible and contemplated. The exact number of microphone elements 310 placed in each of the clusters 302*a,b*, 304*a,b*, 306*a,b* may depend on, for example, space constraints, cost, performance tradeoffs, and/or the amount of signal boost desired for a given frequency band of the microphone array. As an example, clusters of four microphone elements may be preferred for lower frequency bands, which are placed on the outer edges of the microphone array where space is abundant, while clusters of two microphone elements may be preferred for higher frequency bands, which are placed towards the center of the microphone array where space is limited.

Each of the nested pairs 302, 304, 306 (also referred to herein as a "cluster-pair") includes a first or front cluster 302*a*, 304*a*, or 306*a* and a duplicate or back cluster 302*b*, 304*b*, or 306*b*, respectively, that is identical to the corresponding first cluster 302*a*, 304*a*, or 306*a* in terms of the number (e.g., 2, 4, etc.) and arrangement (e.g., spacing, symmetry, etc.) of the microphone elements 310 therein. Further, within each of the cluster-pairs 302, 304, 306, the duplicate cluster 302*b*, 304*b*, or 306*b* can be spaced apart from the corresponding first cluster 302*a*, 304*a*, or 306*a* by a specified distance in order to achieve optimal microphone operation within a selected frequency band, similar to Sets 1, 2, 3 of FIG. 2. For example, in one embodiment, the clusters 302*a,b*, 304*a,b*, and 306*a,b* are spaced apart by the distances d1, d2, and d3, respectively, so that the first cluster-pair 302 forms a microphone array configured to cover a higher frequency band, the second cluster-pair 304 forms a microphone array configured to cover a middle frequency band, and the third cluster-pair 306 forms a microphone array configured to cover a lower frequency band.

The cluster-pairs 302, 304, 306 can be arranged in a nested configuration, similar to the nested configuration shown in FIG. 2. In the illustrated embodiment, the microphone 300 includes a first cluster-pair 302 comprising microphone clusters 302*a* and 302*b* spaced apart by a first or smallest distance, a second cluster-pair 304 comprising microphone clusters 304*a* and 304*b* spaced apart by a second or intermediate distance, and a third cluster-pair 306 comprising microphone clusters 306*a* and 306*b* spaced apart by a third or largest distance. The nested configuration can be formed by placing the microphone clusters 306*a,b* of the third cluster-pair 306 on the outer edges of the first axis 308, placing or nesting the microphone clusters 304*a,b* of the second cluster-pair 304 between the clusters 306*a,b* of the third cluster-pair 306, and placing or nesting the microphone clusters 302*a,b* of the first cluster-pair 302 between the clusters 304*a,b* of the second cluster-pair 304. While three cluster-pairs are shown in FIG. 3 along the first axis 308, other numbers (e.g., fewer or greater) of cluster-pairs are possible and contemplated.

In some embodiments, the microphone 300 further includes a second plurality of microphone elements 312 arranged along a second axis 314 of the microphone 300 that is orthogonal to the first axis 308. The microphone elements 312 may be organized in first, second, and third cluster-pairs 316, 318, 320 that correspond to, or are duplicates of, the first, second, and third cluster-pairs 302, 304, 306 along the first axis 308, respectively. That is, clusters 316*a,b* on the second axis 314 are spaced apart by the same first distance, d1, and contain the same number and arrangement of microphone elements 312, as the clusters 302*a,b*, respectively, on the first axis 308. Likewise, clusters 318*a,b* on the second axis 314 are spaced apart by the same second distance, d2, and contain the same number and arrangement of microphone elements 312, as the clusters 304*a,b*, respectively, on the first axis 308. And clusters 320*a,b* on the second axis 314 are spaced apart by the same third distance, d3, and contain the same number and arrangement of microphone elements 312, as the clusters 306*a,b*, respectively, on the first axis 308. In this manner, the linear nested array formed along the first axis 308 can be superimposed onto the second axis 314.

In the illustrated embodiment, a center of the first axis 308 is aligned with a center of the second axis 314, and each of the cluster-pairs 302, 304, 306, 316, 318, 320 is symmetrically placed on, or centered about, the axis that is orthogonal to it (e.g., axis 314 or 308). This ensures that the linear microphone array formed by the microphone elements 310 on the first axis 308 shares a center or midpoint with the linear microphone array formed by the microphone elements 312 on the second axis 314. In embodiments, appropriate beamforming techniques can be applied to the orthogonal linear arrays of the microphone 300 to create a toroidal pickup pattern and/or to form a first order polar-pattern (such as, e.g., super cardioid, hypercardioid, etc.) and steer that polar pattern to a desired angle to obtain planar directionality. For example, while the microphone elements 310 along the first axis 308 can be used to create a linear array with a directional polar pattern, such as, e.g., a cardioid pickup pattern, the combination of two orthogonal linear arrays along the axes 308 and 314 may form a toroidal pickup pattern or a planar directional polar pattern. In some embodiments, appropriate beamforming techniques can form a unidirectional or cardioid polar pattern pointed toward the end of each axis, or a total of four polar patterns pointing in four different planar directions, to maximize pickup all around the microphone 300. In other embodiments, additional polar patterns may be created by combining the original four polar patterns and steering the combined pattern to any angle along the plane of, for example, the table on which the microphone 100 rests.

In some embodiments, the microphone 300 further includes additional microphone elements 322 placed along one or more optional axes of the microphone 300, such as, e.g., diagonal axes 324 and 326 shown in FIG. 3, to boost SNR or increase microphone sensitivity or directivity within a given frequency band. The additional microphone elements 322 may be arranged as single elements (not shown) or in clusters, as shown in FIG. 3.

Referring now to FIG. 4, shown is another exemplary microphone 400 comprising a first linear microphone array 402 arranged along a first axis 404 and a second linear microphone array 406 arranged along a second axis 408 that is orthogonal to the first axis 404, in accordance with embodiments. Like the microphone 300 shown in FIG. 3, the orthogonal linear arrays 402 and 406 can be used to create a planar directional polar pattern for the microphone 400. Also like the microphone 300, the linear microphone array 402 includes three nested cluster-pairs 410, 412, and 414 on the first axis 404, the linear microphone array 406 includes three corresponding nested cluster-pairs 416, 418, and 420 on the second axis 408, and all of the microphone elements included therein are positioned on a first side or surface 422 of a support 423 (e.g., a frame, a PCB, a substrate, etc.) included in the microphone 400. The microphone elements can be electrically and/or mechanically coupled to the support 423, which generally defines an overall size and shape (shown here as a circle) of the microphone 400. In FIG. 4, each of the cluster-pairs 410, 412, 414, 416, 418, 420 includes clusters of four microphone elements (or "quads"). Other numbers of microphone elements per cluster are possible and contemplated.

In embodiments, the microphone 400 can further include a plurality of microphone elements positioned on a second side or surface (not shown) of the support 423, opposite the first surface 422, to increase the number of distinct frequency bands covered by the microphone 400. In the illustrated embodiment, the linear microphone array 402 includes a fourth cluster-pair 424 positioned on the second surface of the support 423, opposite the cluster-pairs 410, 412, and 414. As an example, the second surface may be a top or front surface of the microphone 400, while the first surface 422 is the back or bottom surface of the microphone 400, or vice versa. As shown, the fourth cluster-pair 424 includes clusters 424*a* and 424*b*, each of which includes a pair of microphone elements, spaced apart by a fourth distance that is smaller than a first distance between clusters 410*a,b* of the first cluster-pair 410. For example, in one embodiment, the fourth distance between clusters 424*a,b* is 7 mm, while the first distance between clusters 410*a,b* is 15.9 mm, a second distance between clusters 412*a,b* is 40 mm, and a third distance between clusters 414*a,b* is 88.9 mm. As such, the fourth cluster-pair 424 is nested within the first cluster-pair 410, but along an opposite side of the first axis 404. Similarly, the linear microphone array 406 can further include a fourth cluster-pair 426 comprising clusters 426*a,b*, each of which includes a pair of microphone elements. The clusters 426*a,b* are also spaced apart from each other by the fourth distance and are nested within a first cluster-pair 416 but along the opposite side of the second axis 408. While two cluster-pairs comprising eight microphone elements in total are shown as being arranged on the second surface of the microphone 400, more or fewer cluster-pairs and/or microphone elements are possible and contemplated.

The fourth distance may be selected to provide coverage of a higher frequency band than, for example, the high frequency band covered by the first cluster-pairs 410 and 416. For example, in certain embodiments, it may not be possible to place the fourth cluster-pairs 424 and 426 on the same surface 422 as the other cluster-pairs 410, 412, 414 due to a lack of remaining space there between. Placement of microphone elements on the opposite surface of the support 423 increases the amount of usable surface area, which enables coverage of additional frequency bands, including higher bands. For example, the microphone 400 may have broader overall frequency band coverage than, for example, the microphone 300. While coverage of four frequency bands is described herein, additional frequency bands may be added, through placement of additional sets of microphone elements appropriately spaced apart along each axis, until all desired bandwidths and/or the entire audible spectrum are covered within the requisite SNR target.

Figure 5:
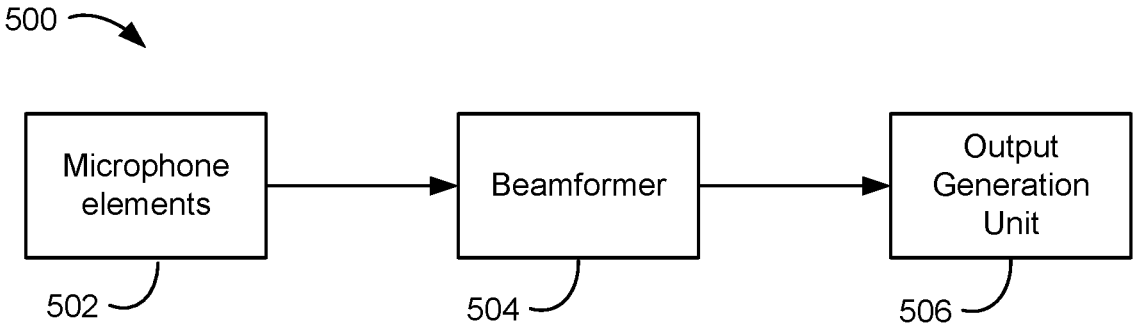
FIG. 5 is a block diagram of an exemplary microphone system in accordance with one or more embodiments.

FIG. 5 illustrates an exemplary microphone system 500 in accordance with embodiments. The microphone system 500 comprises a plurality of microphone elements 502, a beamformer 504, and an output generation unit 506. Various components of the microphone system 500 may be implemented using software executable by one or more computers, such as a computing device with a processor and memory, and/or by hardware (e.g., discrete logic circuits, application specific integrated circuits (ASIC), programmable gate arrays (PGA), field programmable gate arrays (FPGA), etc.). For example, some or all components of the beamformer 504 may be implemented using discrete circuitry devices and/or using one or more processors (e.g., audio processor and/or digital signal processor) (not shown) executing program code stored in a memory (not shown), the program code being configured to carry out one or more processes or operations described herein, such as, for example, method 800 shown in FIG. 8. Thus, in embodiments, the system 500 may include one or more processors, memory devices, computing devices, and/or other hardware components not shown in FIG. 5. In a preferred embodiment, the system 500 includes at least two separate processors, one for consolidating and formatting all of the microphone elements and another for implementing DSP functionality.

The microphone elements 502 may include the microphone elements included in any of the microphone 100 shown in FIG. 1, the microphone 300 shown in FIG. 3, the microphone 400 shown in FIG. 4, or other microphone designed in accordance with the techniques described herein. The beamformer 504 may be in communication with the microphone elements 502 and may be used to beamform audio signals captured by the microphone elements 502. The output generation unit 506 may be in communication with the beamformer 504 and may be used to process the output signals received from the beamformer 504 for output generation via, for example, loudspeaker, telecast, etc.

Figure 6:
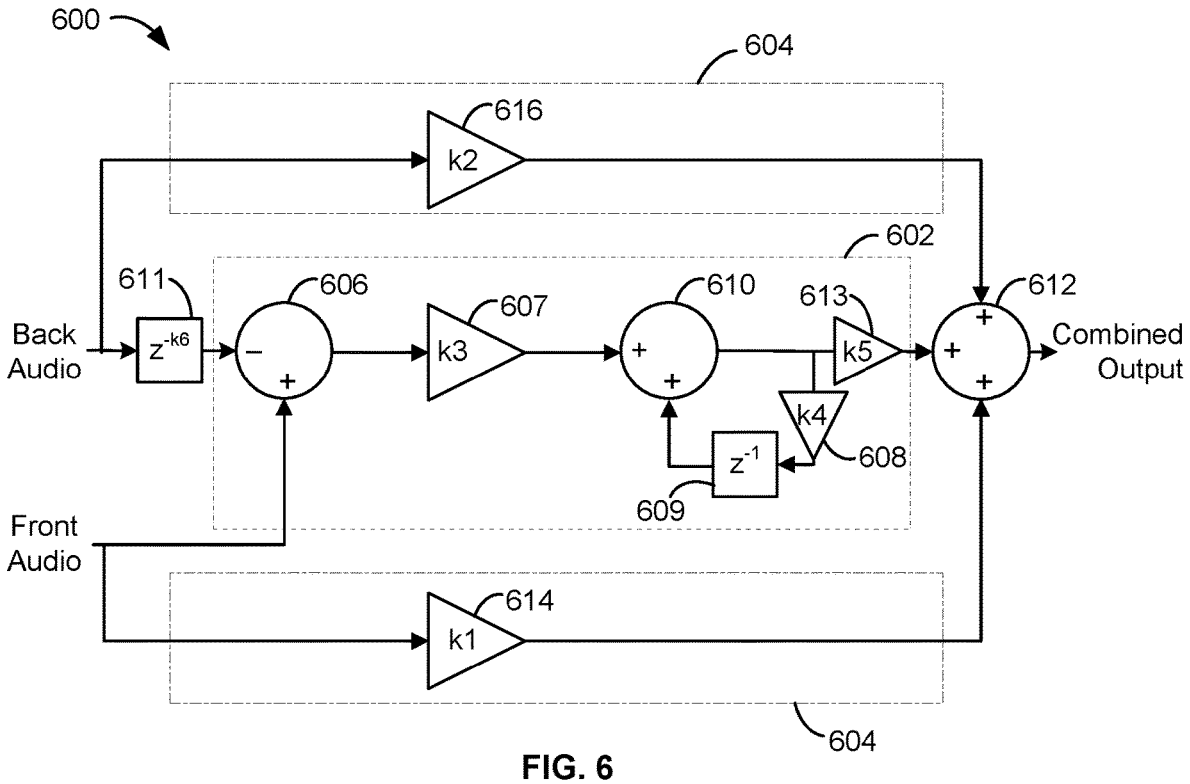
FIG. 6 is a block diagram illustrating an exemplary pattern-forming beamformer for combining audio signals captured by a given set of microphone elements, in accordance with one or more embodiments.
Figure 7:
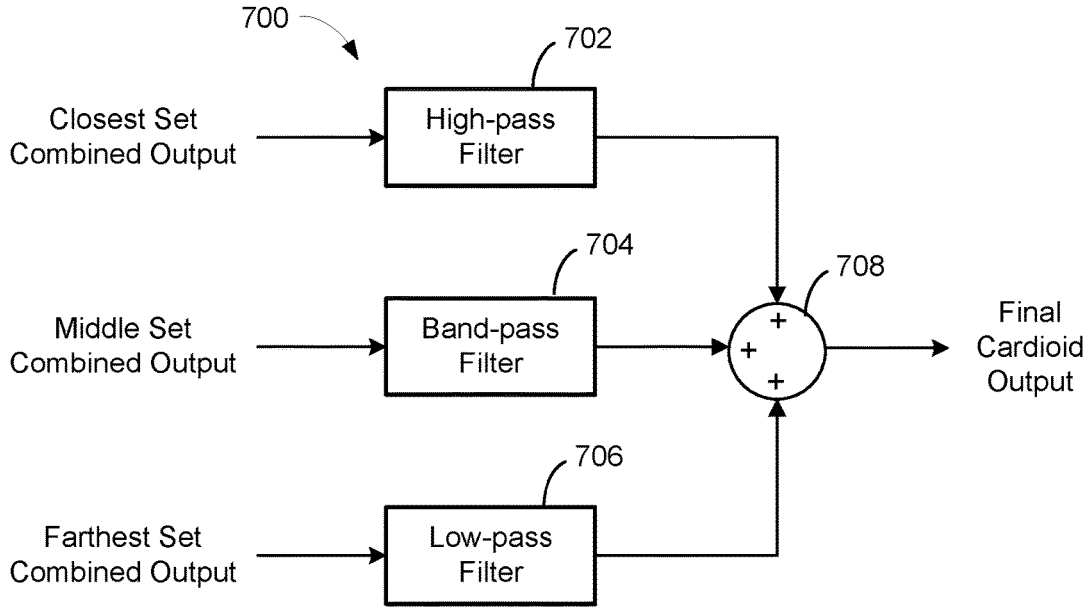
FIG. 7 is a block diagram illustrating an exemplary pattern-combining beamformer for combining audio outputs received from nested sets of microphone elements, in accordance with one or more embodiments.

In embodiments, the beamformer 504 may include one or more components to facilitate processing of the audio signals received from the microphone elements 502, such as, e.g., pattern-forming beamformer 600 of FIG. 6 and/or pattern-combining beamformer 700 of FIG. 7. As described in more detail below with reference to FIG. 8, pattern-forming beamformer 600 combines audio signals captured by a set of microphone elements arranged in a linear array to form a combined output signal having a directional polar pattern, in accordance with embodiments. And pattern-combining beamformer 700 combines the output signals received from multiple nested sets in a microphone array to form a final cardioid output for the overall array, in accordance with embodiments. Other beamforming techniques may also be performed by the beamformer 504 to obtain a desired output.

Figure 8:
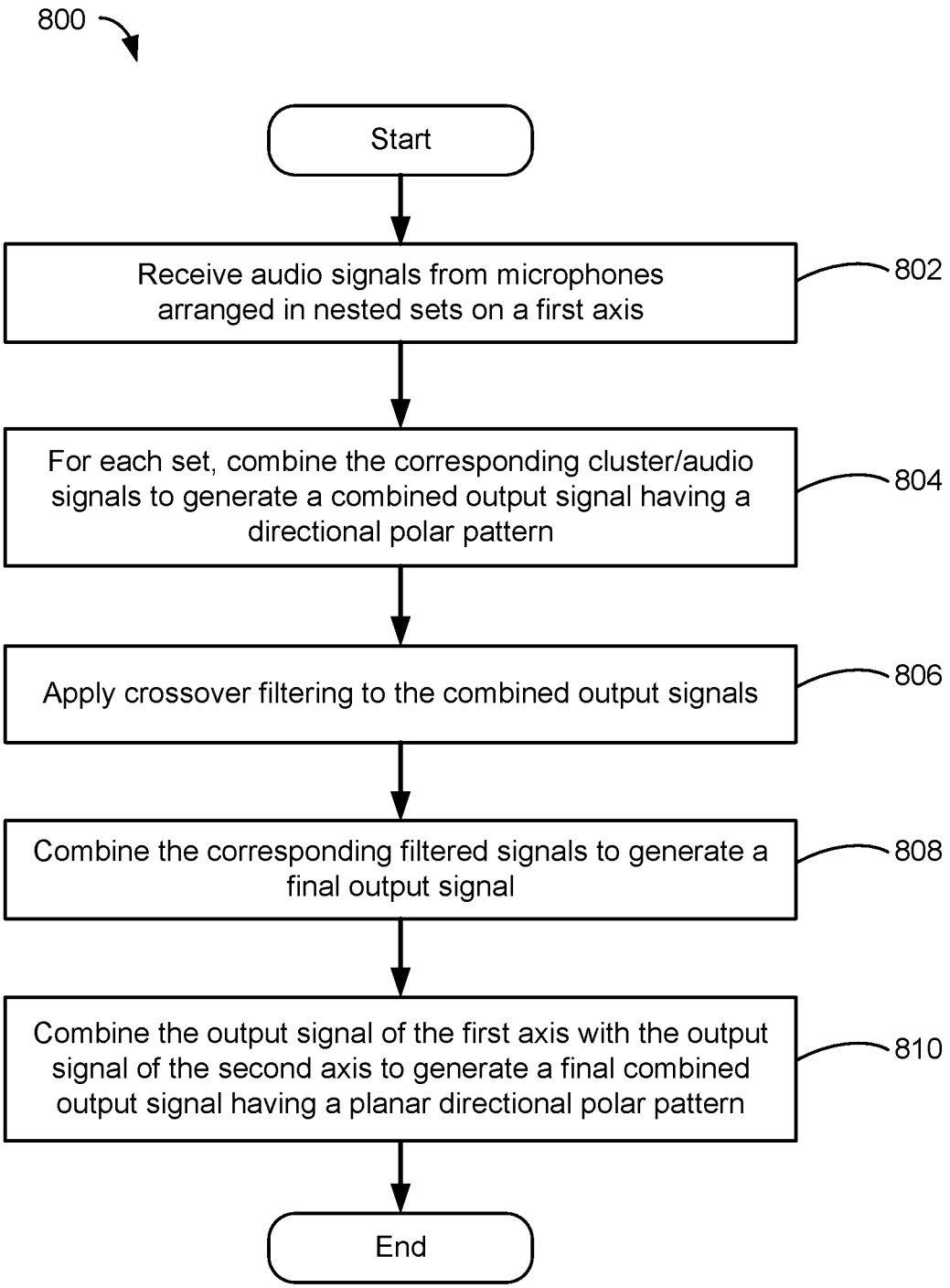
FIG. 8 is a flowchart illustrating an exemplary method performed by an audio processor to generate a beamformed output signal with a directional polar pattern for a microphone array comprising at least one linear nested array, in accordance with one or more embodiments.

FIG. 8 illustrates an exemplary method 800 of generating a beamformed output signal with a directional polar pattern for a microphone array comprising at least one linear nested array, in accordance with embodiments. All or portions of the method 800 may be performed by one or more processors (such as, e.g., an audio processor included in the microphone system 500 of FIG. 5) and/or other processing devices (e.g., analog to digital converters, encryption chips, etc.) within or external to the microphone. In addition, one or more other types of components (e.g., memory, input and/or output devices, transmitters, receivers, buffers, drivers, discrete components, logic circuits, etc.) may also be utilized in conjunction with the processors and/or other processing components to perform any, some, or all of the steps of the method 800. For example, program code stored in a memory of the system 500 may be executed by the audio processor in order to carry out one or more operations of the method 800.

In some embodiments, certain operations of the method 800 may be performed by the pattern-forming beamformer 600 of FIG. 6, and other operations of the method 800 may be performed by the pattern-combining beamformer 700 of FIG. 7. The microphone array may be any of the microphone arrays described herein, such as, e.g., the microphone array 200 of FIG. 2, one or more of the linear microphone arrays in the microphone 300 of FIG. 3, or one or more of the linear microphone arrays 402 and 406 shown in FIG. 4. In some embodiments, the microphone array includes a plurality of microphone elements coupled to a support, such as, e.g., the support 112 of FIG. 1, the support 311 of FIG. 3, or the support 423 of FIG. 4. The microphone elements may be, for example, MEMS transducers which are inherently omnidirectional, other types of omnidirectional microphones, electret or condenser microphones, or other types of omnidirectional transducers or sensors.

Referring back to FIG. 8, the method 800 begins, at block 802, with a beamformer or processor, receiving audio signals from a plurality of microphone elements (e.g., microphone elements 502 of FIG. 5) arranged in a nested configuration along one or more axes of a microphone support. The nested configuration may take different forms, for example, as shown by the different microphone arrays of FIGS. 1-4. As an example, the plurality of microphone elements can include a first set of microphone elements arranged along the first axis (e.g., axis 308 of FIG. 3) and nested within a second set of microphone elements also on the same axis. The first set (e.g., Set 1 of FIG. 2) may include at least two microphone elements (e.g., microphone elements 102*a,b* of FIG. 2) spaced apart from each other by a first distance (e.g., d1 of FIG. 2) selected for optimal microphone operation in a first frequency band. The second set (e.g., Set 2 of FIG. 2) may include at least two microphone elements (e.g., microphone elements 104*a,b* of FIG. 2) spaced apart from each other by a second distance (e.g., d2 of FIG. 2) that is greater than the first distance and is selected for optimal microphone operation in a second frequency band lower than the first frequency band. The microphone elements of each set may be symmetrically positioned on the first axis, for example, relative to a second, orthogonal axis (e.g., as shown in FIG. 1).

In some embodiments, the plurality of microphone elements may further include a third set (e.g., Set 3 of FIG. 2) of elements comprising at least two microphone elements (e.g., microphone elements 106*a,b* of FIG. 2) spaced apart from each other by a third distance (e.g., d3 of FIG. 2) along the first axis. The third distance may be larger than the second distance, so that the second set can be nested within the third set. The third distance may be selected to configure the third set of microphone elements for optimal microphone operation in a third frequency band that is lower than the second frequency band.

In some embodiments, at least one of the nested sets is comprised of two clusters of microphone elements spaced apart by the specified distance along the first axis (e.g., as shown in FIG. 3), instead of two individual microphone elements. For such sets, the at least two microphone elements may include a first cluster of two or more microphone elements (e.g., cluster 302*a*, 304*a*, or 306*a* of FIG. 3) and a second cluster of two or more microphone elements (e.g., cluster 302*b*, 304*b*, or 306*b* of FIG. 3) located a specified distance (e.g., d1, d2, or d3) from the first cluster. The second cluster for each set may correspond with, or be a duplicate of, the first cluster of that set in terms of number (e.g., 2, 4, etc.) and arrangement (e.g., placement, spacing, symmetry, etc.) of microphone elements.

At block 804, for each set of microphone elements along a given axis, the audio signals received from the microphone elements of that set are combined to generate an output signal having a directional polar pattern, such as, e.g., a cardioid polar pattern. In certain embodiments, combining the audio signals for a given set of microphone elements at block 804 includes subtracting the audio signals received from the microphone elements therein to generate a first signal having a bidirectional polar pattern, summing the received audio signals to generate a second signal having an omnidirectional polar pattern, and summing the first and second signals to generate a combined output signal having a cardioid polar pattern. As will be appreciated, the operations associated with block 804 may be repeated until all sets within the microphone array have corresponding output signals representing the combined outputs of the microphone elements therein.

If the microphone elements are arranged in clusters, the signal combining process at block 804 may include, prior to generating the first signal, creating a cluster signal for each cluster in the set (e.g., front cluster and back cluster) based on the audio signals captured by the microphone elements in that cluster. The cluster signal may be created by, for example, summing the audio signals received from each of the closely-located microphone elements included in that cluster and normalizing the summed result. Each cluster of microphone elements may effectively operate as a single, higher sensitivity microphone that provides a boost in SNR (as compared to the individual microphone elements). Once front and back cluster signals are created for each cluster within the set (or cluster-pair), the front and back cluster signals for each set may be combined in accordance with block 804 to generate the combined output signal for that set. Other techniques for combining the audio signals for each microphone cluster are also possible and contemplated.

In embodiments, all or portions of the signal combining process in block 804 may be performed by the exemplary pattern-forming beamformer 600 of FIG. 6. As shown, the beamformer 600 receives audio signals produced or output by one or more front microphone elements (e.g., a single element or a front cluster of elements) and one or more back microphone elements (e.g., a single element or a back cluster of elements) included in a set (or cluster-pair) of a microphone array. The front and back elements may be spaced apart from each other by a specified distance along a first axis. In a preferred embodiment, the microphone elements are MEMS transducers that inherently have an omnidirectional polar pattern. If the microphone array includes spaced apart clusters of microphone elements, the received audio signals may be the corresponding front and back cluster signals for the given cluster-pair.

As shown in FIG. 6, the front and back audio signals are provided to two different segments of the beamformer 600. A first segment 602 generates a first output signal having a bidirectional, or other first order polar pattern by, among other things, taking a differential of the audio signals received from the omnidirectional microphone elements of the given cluster-pair. A second segment 604 generates a second output signal having an omnidirectional polar pattern, at least within the frequencies of interest, by, among other things, summing the audio signals received from the omnidirectional microphone elements. The outputs of the first segment 602 and the second segment 604 are summed together to generate a combined output signal with a cardioid pickup pattern, or other directional polar pattern.

In embodiments, the first segment 602 can perform subtraction, integration, and delay operations on the received audio signals to create the bidirectional or other first order polar pattern. As shown in FIG. 6, the first segment 602 includes a subtraction (or invert-and-sum) element 606 that is in communication with the front and back microphone elements. The subtraction element 606 generates a differential signal by subtracting the back audio signal from the front audio signal.

The first segment 602 also includes an integration subsystem for performing an integration operation on the differential signal received from the subtraction element 606. In some embodiments, the integration subsystem can operate as a correction filter that corrects for the sloped frequency response of the differential signal output by the subtraction element 606. For example, the correction filter may have a sloped frequency response that is the inverse of the differential signal's sloped response. Additionally, the correction filter may add a 90 degree phase shift to the output of the first segment 602, so that the front of the pattern is phase-aligned and the back of the pattern is anti-aligned, thus enabling creation of the cardioid pattern. In some embodiments, the integration subsystem may be implemented using appropriately configured low-pass filters.

In the illustrated embodiment, the integration subsystem includes an integration gain element 607 configured to apply a gain factor k3 (also known as an integration constant) to the differential signal. The integration constant k3 may be tuned to the known separation or distance (e.g., d1, d2, or d3) between the microphone clusters (or elements). For example, the integration constant k3 may be equal to (speed of sound)/(sample rate)/(distance between clusters). The integration subsystem also includes a feedback loop formed by a feedback gain element 608, a delay element 609, and a summation element 610, as shown. The feedback gain element 608 has a gain factor k4 that may be selected to configure the feedback gain element 608 as a "leaky" integrator, so as to make the first segment 602 more robust against feedback instabilities, as needed. As an example, in some embodiments, the gain factor k4 may be equal to or less than one (1). The delay element 609 adds an appropriate amount of delay (e.g., $z^{-1}$) to the output of the feedback gain element 608. In the illustrated embodiment, the delay amount is set to one (i.e. a single sample delay).

In some embodiments, the first segment 602 also includes a second delay element 611 at the beginning of the first segment 602, as shown in FIG. 6, in order to add a delay (e.g., $z^{-k6}$) to the back audio signal before subtraction by element 606. The "k6" parameter of the second delay element 611 may be selected based on a desired first order polar pattern for the path 602. For example, when k6 is set to zero (0), the first segment 602 creates a bidirectional polar pattern, However, when k6 is set to an integer greater than zero, other first order polar patterns may be created.

As shown in FIG. 6, the output of the summation element 610 (or the output of the integration subsystem) may be provided to a final summation element 612 that also receives the outputs of the second segment 604. In some embodiments, the first segment 602 further includes a gain element 613, with gain factor k5, coupled between the output of the integration subsystem and an input for the final summation element 612. The gain element 613 may be configured to apply an appropriate amount of gain to the corrected output of the integration subsystem, before reaching the summation element 612. The exact amount of gain k5 may be selected based on gain amounts applied in the second segment 604, as described below.

The second segment 604 can perform summation and gain operations on the audio signals received from the given set of microphone elements to create the omnidirectional response. As shown in FIG. 6, the second segment 604 includes a first gain element 614, with gain factor k1, in communication with the front microphone element(s) and a second gain element 616, with gain factor k2, in communication with the back microphone element(s). In some embodiments, the gain elements 614 and 616 can be configured to normalize the output of the front and back microphone elements. For example, the gain factors k1 and k2 for the gain elements 614 and 616 may be set to 0.5 (or ½), so that the output of the second segment 604 matches the output of a single omnidirectional microphone in terms of magnitude. Other gain amounts are possible and contemplated.

In some embodiments, the gain component 613 may be included on the first segment 602 as an alternative to the first and second gain elements 614, 616 of the second segment 604. In other embodiments, all three gain components 613, 614, 616 may be included, and the gain factors k1, k2, k5 may be configured in order to add an appropriate amount of gain to the corrected output of the integration subsystem and/or the output of the second segment 604, before they reach the summation element 612. For example, the amount of gain k5 may be selected in order to obtain a specific first order polar pattern. In a preferred embodiment, to create a cardioid pattern, the gain factor k5 may be set to one (1), so that the output of the first segment 602 (e.g., the bidirectional component) matches the output of the second segment 604 (e.g., the omnidirectional component) in terms of magnitude. Other values for the gain factor k5 may be selected depending on the desired polar pattern for the first segment path 602, the value selected for the k6 parameter of the initial delay element 611, and/or the desired polar pattern for the overall set of microphone elements.

As shown in FIG. 6, the outputs of the gain elements 614 and 616 can be provided to the final summation element 612, which sums the outputs to generate the omnidirectional output of the second segment 604. The final summation element 612 also sums the output of the second segment 604 with the bidirectional (or other first order pattern) output of the first segment 602, thus generating the cardioid (or other first order pattern) output of the beamformer 600.

Referring back to FIG. 8, once a final output signal having a directional polar pattern is obtained at block 804, the method 800 continues to block 806, where crossover filtering is applied to the combined output signal generated for each set of microphone elements arranged along a given axis, so that each set can optimally cover the frequency band associated therewith. At block 808, the filtered outputs for each set of microphone elements may be combined to generate a final output signal for the microphone elements on that axis.

In embodiments, the crossover filtering includes applying an appropriate filter to the output of each set (or cluster-pair) in order to isolate the combined output signals into different or discrete frequency bands. As will be appreciated, there is an inverse relationship between the amount of separation between elements (or clusters) in a given set (or cluster-pair) and the frequency band(s) that can be optimally covered by that set. For example, larger microphone spacings may have a smaller low frequency response loss, thus resulting in a better low frequency SNR. At the same time, larger spacings can have a lower frequency null, and smaller spacings can have a higher frequency null. In embodiments, crossover filtering can be applied to avoid these nulls and stitch together an ideal frequency response for the microphone array, while maintaining an SNR that is better than a single, closely-spaced pair of microphones.

According to embodiments, all or portions of blocks 806 and 808 may be performed by exemplary pattern-combining beamformer 700 of FIG. 7. In the illustrated embodiment, the beamformer 700 receives combined output signals for a nearest, or most closely-spaced, set of microphone elements (e.g., clusters 302*a,b* of FIG. 3), an intermediate, or medium-spaced, set of microphone elements (e.g., clusters 304*a,b* of FIG. 3), and a furthest, or farthest-spaced, set of microphone elements (e.g., clusters 306*a,b* of FIG. 3), all along a first axis. In embodiments, the beamformer 700 may be in communication with a plurality of beamformers 600 in order to receive the combined output signals. For example, a separate beamformer 600 may be coupled to each cluster-pair (or set) included in the microphone array, so that the respective beamformer 600 can be tailored to, for example, the separation distance of that cluster-pair and/or other factors.

As shown, the beamformer 700 includes a plurality of filters 702, 704, 706 to implement the crossover filtering process. In the illustrated example, the combined output signal for the closest set is provided to high-pass filter 702, the combined output signal for the middle set is provided to bandpass filter 704, and the combined output signal for the farthest set is provided to low-pass filter 706. The cutoff frequencies for filters 702, 704, and 706 may be selected based on the specific frequency response characteristics of the corresponding set or cluster-pair, including, for example, location of frequency nulls, a desired frequency response for the microphone array, etc. According to one embodiment, for the bandpass filter 704, the high frequency cutoff may be determined by the natural −1 decibel (dB) point of the cardioid frequency response for the corresponding combined output signal, and the low frequency cutoff may be determined by the cutoff of the lower band, but no lower than 20 hertz (Hz). The filters 702, 704, 706 may be analog or digital filters. In a preferred embodiment, the filters 702, 704, 706 are implemented using digital finite impulse response (FIR) filters on a digital signal processor (DSP) or the like.

In other embodiments, the beamformer 700 may include more or fewer filters. For example, the beamformer 700 could be configured to include four filters or two filters, instead of the illustrated three band solution. In still other embodiments, the beamformer 700 may include a different combination of filters. For example, the beamformer 700 may be configured to include multiple bandpass filters, instead of high-pass or low-pass filters, or any other combination of bandpass, low-pass, and/or high-pass filters.

As shown in FIG. 7, the filtered outputs are provided to a summation element 708 of the beamformer 700. The summation element 708 combines or sums the filtered outputs to generate an output signal, which may represent a final cardioid output for the microphone elements included on the first axis of the microphone array, or other first order polar pattern.

In some embodiments, the plurality of microphone elements for a given microphone array further includes additional sets of elements arranged along a second axis (e.g., axis 314 of FIG. 3) that is orthogonal to the first axis. The additional sets on the second axis may be duplicates or copies of the sets arranged on the first axis in terms of arrangement (e.g., nesting, spacing, clustering, etc.) and number of microphone elements (e.g., 1, 2, 4, etc.) For example, the additional sets of microphone elements may include a first set (e.g., cluster-pair 316 of FIG. 3) nested within a second set (e.g., cluster-pair 318 of FIG. 3) along the second axis. Like the first set arranged along the first axis, the first set on the second axis may include at least two microphone elements (e.g., clusters 316*a,b* of FIG. 3) spaced apart from each other by the first distance (e.g., d1 of FIG. 2), so as to optimally cover the first frequency band. Likewise, the second set may include at least two microphone elements (e.g., clusters 318*a,b* of FIG. 3) spaced apart from each other by the second distance (e.g., d2 of FIG. 2), so as to optimally cover the second frequency band, similar to the second set on the first axis.

Referring back to FIG. 8, in cases where the microphone array includes microphone elements on two orthogonal axes, the method 800 may further include, at block 810, combining the final output signal generated for the first axis with a final output signal generated for the second axis in order to create a final combined output signal having a planar and/or steerable directional polar pattern. In such cases, blocks 802 to 808 may be applied to the microphone elements arranged on the second axis to generate the final output signal for that axis.

For example, at block 802, audio signals may also be received from each microphone element on the second axis, in addition to the first axis. At block 804, a combined output signal may be generated for each set (or cluster-pair) of microphone elements arranged on the second axis, in addition to the first axis. That is, the combining process in block 804 (and as shown in FIG. 6) may be repeated for each set of elements on each axis of the array. The filter and combine processes in blocks 806 and 808 (and as shown in FIG. 7) may be performed in an axis-by-axis manner. That is, the combined output signals for the sets included on the second axis may be filtered and combined together in one beamforming process, while the combined output signals for the sets included on the second axis may be filtered and combined together in another beamforming process, either simultaneously or consecutively. The final output signals generated for each axis at block 808 can then be provided to block 810.

At block 810, the final output signal for the first axis is combined with the final output signal for the second axis to obtain a final combined output signal with a planar directional response (e.g., toroidal, unidirectional, etc.). The signals for the two axes can be combined using weighting and summing techniques, if a steered first order polar pattern is desired, or using filtering and summing techniques, if a toroidal polar pattern is desired. For example, appropriate weighting values can be applied to the output signals for each axis to create different polar patterns and/or steer the lobes of the pickup pattern to a desired direction.

In accordance with certain embodiments, a method of assembling a microphone array can comprise forming a first set of microphone elements along a first axis, the first set including at least two microphone elements spaced apart from each other by a first distance; forming a second set of microphone elements along the first axis, the second set including at least two microphone elements spaced apart from each other by a second distance greater than the first distance, such that the first set is nested within the second set; and electrically coupling each microphone element to at least one processor for processing audio signals captured by the microphone elements, wherein the first distance is selected for optimal microphone operation in a first frequency band, and the second distance is selected for optimal microphone operation in a second frequency band that is lower than the first frequency band. According to aspects, the method can further comprise forming a third set of elements positioned along a second axis orthogonal to the first axis, the third set comprising at least two microphone elements spaced apart from each other by the second distance; and forming a fourth set of elements nested within the third set along the second axis, the fourth set comprising at least two microphone elements spaced apart from each other by the first distance. According to further aspects, the method can also comprise forming a fifth set of elements comprising at least two microphone elements spaced apart from each other by a third distance along the first axis, the third distance being greater than the second distance, so that the second set is nested within the fifth set, wherein the third distance is selected for optimal microphone operation in a third frequency band that is lower than the second frequency band. According to other aspects, the method can further comprise placing a select one of the first and second sets on a first surface of the microphone array, and placing the remaining set on a second surface opposite the first surface.

Figure 9:
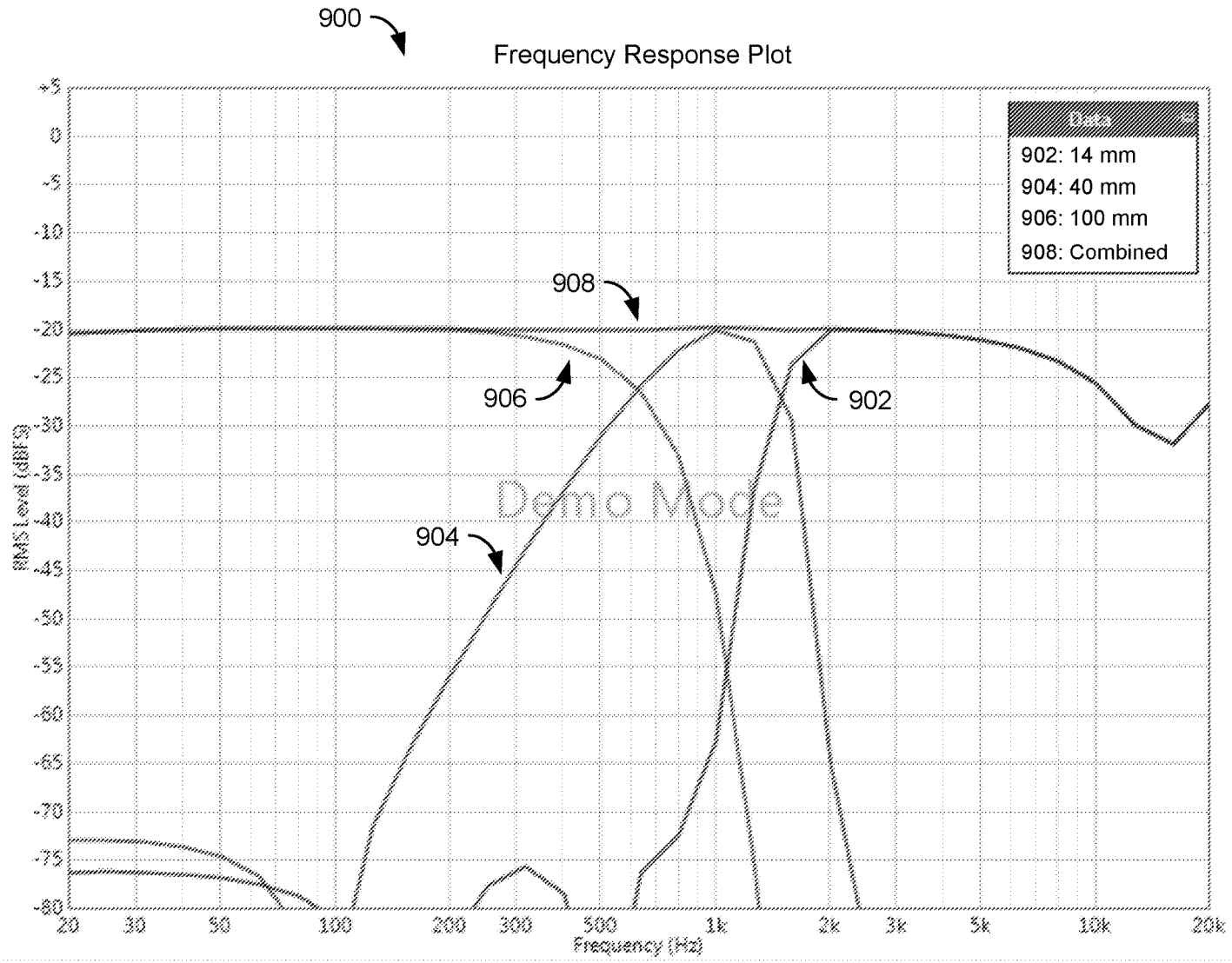
FIG. 9 is a frequency response plot of an exemplary microphone array in accordance with one or more embodiments.

FIG. 9 is a frequency response plot 900 for an exemplary microphone array with three sets of microphone elements arranged in a linear nested array, for example, similar to the cluster-pairs 302, 304, 306 arranged along the first axis 308 in FIG. 3, in accordance with embodiments. In particular, the plot 900 shows filtered frequency responses for a closest set (902) including microphone clusters spaced 14 millimeters (mm) apart, a middle set (904) including microphone clusters spaced 40 mm apart, and a farthest set (906) including microphone clusters spaced 100 mm apart. In addition, plot 900 shows a combined frequency response 908 for all three sets of the linear nested array. In embodiments, the frequency responses 902, 904, 906 represent the filtered outputs of respective crossover filters 702, 704, 706 included in the pattern-combining beamformer 700 of FIG. 7, and the frequency response 908 is the combined output, or summation, of the filtered signals.

As shown, the frequency response 902 of the closest set flattens out after about 2 kilohertz (kHz), while the frequency response 906 of the farthest set is generally flat until about 200 Hz. The frequency response 904 of the middle set peaks at about 1 kHz, with a −6 dB/octave rise crossing the farthest set response 906 at about 650 Hz and a −6 dB/octave drop crossing the closest set response 902 at about 1.5 kHz. The filtered and combined frequency response 908 stitches the three responses together to provide a generally flat frequency response across almost the entire audio bandwidth (e.g., 20 Hz to 20 kHz), with attenuation only occurring at higher frequencies (e.g., above 5 kHz).

Figure 10:
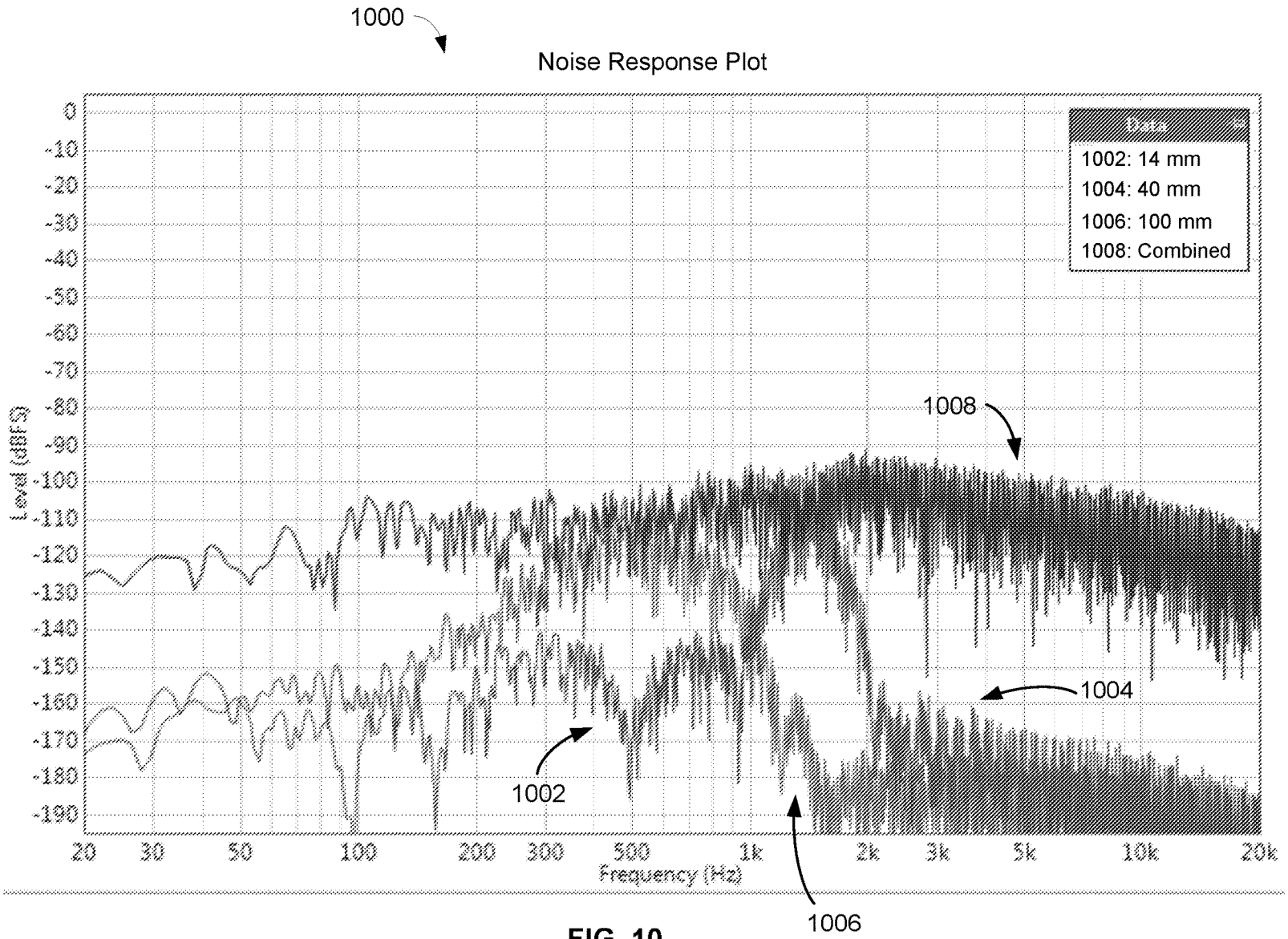
FIG. 10 is a noise response plot of an exemplary microphone array in accordance with one or more embodiments.

FIG. 10 illustrates a noise response plot 1000 for an exemplary microphone array with three sets of microphone elements arranged in a linear nested array, for example, similar to the cluster-pairs 302, 304, 306 arranged along the first axis 308 in FIG. 3, in accordance with embodiments. The noise response plot 1000 corresponds to the filtered and combined frequency response plot 900 shown in FIG. 9. In particular, the noise response plot 1000 shows noise responses that represent the filtered outputs of the closest set (1002), the middle set (1004), and the farthest set (1006), as well as the combined output of all three (1008).

Thus, the techniques described herein provide a high performance microphone capable of having a highly directional polar pattern, improved signal-to-noise ratio (SNR), and wideband audio application (e.g., 20 hertz (Hz)≤f≤20 kilohertz (kHz). The microphone includes at least one linear nested array comprising one or more sets of microphone elements separated by a distance selected to optimally cover a desired operating band. In some cases, the microphone elements are clustered and crossover filtered to further improve SNR characteristics and optimize the frequency response. One or more beamformers can be used to generate a combined output signal for each linear array having a desired directional polar pattern (e.g., cardioid, hypercardioid, etc.). In some cases, at least two linear arrays are symmetrically arranged on orthogonal axes to achieve a planar directional polar pattern (e.g., toroidal, etc.), thus making the microphone optimal for conferencing applications.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A microphone array, comprising:

a plurality of microphone elements comprising:

a first set of elements arranged along a first axis and comprising a first cluster of two or more microphone elements spaced apart from a second cluster of two or more microphone elements by a first distance;

a second set of elements arranged along the first axis and comprising a third cluster of two or more microphone elements spaced apart from a fourth cluster of two or more microphone elements by a second distance greater than the first distance, such that the first set is nested within the second set;

a third set of elements arranged along a second axis orthogonal to the first axis, the third set comprising a fifth cluster of two or more microphone elements spaced apart from a sixth cluster or two or more microphone elements by the second distance; and a fourth set of elements nested within the third set along the second axis, the fourth set comprising a seventh cluster of two or more microphone elements spaced apart from an eighth cluster of two or more microphone elements by the first distance, wherein the first distance is selected for optimal microphone operation in a first frequency band, and the second distance is selected for optimal microphone operation in a second frequency band that is lower than the first frequency band, and wherein within each cluster, the two or more microphone elements are arranged adjacent to each other and symmetrically about the corresponding axis.

2. The microphone array of claim 1, wherein each cluster included in the first set contains two microphone elements, and each cluster included in the second set contains four microphone elements.

3. The microphone array of claim 1, wherein for each set of elements, the second cluster corresponds with the first cluster in terms of number and arrangement of microphone elements.

4. The microphone array of claim 1, wherein a center of the first axis is aligned with a center of the second axis, and each set of microphone elements is symmetrically arranged relative to the orthogonal axis.

5. The microphone array of claim 1, wherein the third and fourth sets of elements correspond to the first and second sets of elements, respectively, in terms of number and arrangement of microphone elements.

6. The microphone array of claim 1, wherein the plurality of microphone elements further comprises:

a fifth set of elements comprising at least two microphone elements spaced apart from each other by a third distance along the first axis, the third distance being greater than the second distance, so that the second set is nested within the fifth set, wherein the third distance is selected for optimal microphone operation in a third frequency band that is lower than the second frequency band.

7. The microphone array of claim 1, wherein a select one of the first and second sets is placed on a first surface of the microphone array, and the remaining set is placed on a second surface opposite the first surface.

8. The microphone array of claim 7, wherein the first surface is a back face of the microphone array and the second surface is a front face thereof.

9. The microphone array of claim 1, wherein each microphone element is a micro-electrical mechanical system (MEMS) microphone.

10. A microphone system, comprising:

a microphone array including a plurality of microphone elements coupled to a support, the plurality of microphone elements comprising first and second sets of elements arranged along a first axis of the support, the first set being nested within the second set, wherein the first set includes a first cluster of two or more microphone elements spaced apart from a second cluster of two or more microphone elements by a first distance selected to configure the first set for optimal microphone operation in a first frequency band, and the second set includes a third cluster of two or more microphone elements spaced apart from a fourth cluster of two or more microphone elements by a second distance that is greater than the first distance, the second distance being selected to configure the second set for optimal microphone operation in a second frequency band that is lower than the first frequency band, and wherein within each cluster, the two or more microphone elements are arranged adjacent to each other and symmetrically about said first axis;

a memory configured to store program code for processing audio signals captured by the plurality of microphone elements and generating an output signal based thereon;

at least one processor in communication with the memory and the microphone array, the at least one processor configured to execute the program code in response to receiving audio signals from the microphone array, wherein the program code is configured to:

receive audio signals from each microphone element of the microphone array;

for each cluster in a given set, sum the audio signals received from the two or more microphone elements in the cluster to generate a cluster signal;

for each set of elements along the first axis, combine the cluster signals for the clusters in the set to generate a combined output signal with a directional polar pattern; and combine the combined output signals for the first and second sets to generate a final output signal for all of the microphone elements on the first axis.

11. The microphone system of claim 10, wherein combine the cluster signals for each set of elements comprises:

subtract the cluster signals to generate a first signal;

sum the cluster signals to generate a second signal; and sum the first and second signals to generate the combined output signal.

12. The microphone system of claim 10, wherein for each set of elements, the clusters correspond with each other in terms of number and arrangement of microphone elements.

13. The microphone system of claim 10, wherein the plurality of microphone elements further comprises third and fourth sets of elements arranged along a second axis of the support orthogonal to the first axis, the third set being nested within the fourth set, and the third and fourth sets corresponding to the first and second sets, respectively, in terms of number and arrangement of microphone elements, and wherein the program code is further configured to:

for each set of elements along the second axis, combine the audio signals for the microphone elements in the set to create a combined output signal with a directional polar pattern;

combine the combined output signals for the third and fourth sets to generate a final output signal for the microphone elements on the second axis; and combine the final output signal of the first axis with the final output signal of the second axis to produce a final combined output signal with a planar directional polar pattern.

14. The microphone system of claim 10, wherein the program code is further configured to:

prior to generating the output signal, apply crossover filtering to the combined output signals so that each set of elements on the first axis optimally covers the frequency band associated therewith.

15. The microphone system of claim 14, wherein the plurality of microphone elements further comprises a fifth set of elements comprising at least two microphone elements spaced apart from each other by a third distance along the first axis, the third distance being larger than the second distance, so that the second set is nested within the fifth set, wherein the third distance is selected to configure the fifth set for optimal microphone operation in a third frequency band that is lower than the second frequency band, and wherein apply crossover filtering includes apply a bandpass filter to the combined output signal of the second set, apply a low pass filter to the combined output signal of the fifth set, and apply a high pass filter to the combined output signal of the first set.

16. The microphone system of claim 10, wherein each microphone element is a micro-electrical mechanical system (MEMS) microphone.

17. A method performed by one or more processors to generate an output signal for a microphone array comprising a plurality of microphone elements coupled to a support, the method comprising:

receiving audio signals from the plurality of microphone elements, the plurality of microphone elements comprising first and second sets of elements arranged along a first axis of the support, the first set being nested within the second set, wherein the first set includes a first cluster of two or more microphone elements spaced apart from a second cluster of two or more microphone elements by a first distance selected to configure the first set for optimal microphone operation in a first frequency band, and the second set includes a third cluster of two or more microphone elements spaced apart from a fourth cluster of two or more microphone elements by a second distance that is greater than the first distance, the second distance being selected to configure the second set for optimal microphone operation in a second frequency band that is lower than the first frequency band, and wherein within each cluster, the two or more microphone elements are arranged adjacent to each other and symmetrically about said first axis;

for each cluster in a given set, summing the audio signals received from the two or more microphone elements in the cluster to generate a cluster signal;

for each set of elements along the first axis, combining the cluster signals for the clusters in the set to generate a combined output signal with a directional polar pattern; and combining the combined output signals for the first and second sets to generate a final output signal for all microphone elements on the first axis.

18. The method of claim 17, wherein combining the cluster signals for each set of elements comprises:

subtracting the cluster signals to generate a first signal;

summing the cluster signals to generate a second signal; and summing the first and second signals to generate the combined output signal.

19. The method of claim 17, wherein for each set of elements, the second clusters correspond to each other in terms of number and arrangement of microphone elements.

20. The method of claim 17, wherein the plurality of microphone elements further comprises third and fourth sets of elements arranged along a second axis of the support orthogonal to the first axis, the third set being nested within the fourth set, wherein the third and fourth sets correspond to the first and second sets, respectively, in terms of number and arrangement of microphone elements, and wherein the method further comprises:

for each set of elements along the second axis, combining the audio signals for the microphone elements in the set to create a combined output signal with a directional polar pattern;

combining the combined output signals for the third and fourth sets to generate a final output signal for all microphone elements on the second axis; and combining the final output signal of the first axis with the final output signal of the second axis to produce a final combined output signal with a higher order polar pattern.

21. The method of claim 17, further comprising:

prior to generating the final output signal for all microphone elements on the first axis, applying crossover filtering to the combined output signals so that each set of elements on the first axis optimally covers the frequency band associated therewith.

22. The method of claim 21, wherein the plurality of microphone elements further comprises a fifth set of elements including at least two microphone elements spaced apart from each other by a third distance along the first axis, the third distance being larger than the second distance, so that the second set is nested within the fifth set, wherein the third distance is selected to configure the fifth set for optimal microphone operation in a third frequency band that is lower than the second frequency band, and wherein applying crossover filtering includes applying a bandpass filter to the combined output signal of the second set, applying a low pass filter to combined output signal of the fifth set, and applying a high pass filter to the combined output signal of the first set.

23. The method of claim 17, wherein each microphone element is a micro-electrical mechanical system (MEMS) microphone.

* * * * *